US006467702B1

(12) United States Patent
Lambert et al.

(10) Patent No.: US 6,467,702 B1
(45) Date of Patent: Oct. 22, 2002

(54) FUEL INJECTOR

(75) Inventors: Malcolm David Dick Lambert, Bromley (GB); Koteswara Rao Kunkulagunta, Rainham (GB)

(73) Assignee: Delphi Technologies, Inc., Troy, MI (US)

( * ) Notice: Subject to any disclaimer, the term of this patent is extended or adjusted under 35 U.S.C. 154(b) by 32 days.

(21) Appl. No.: 09/603,273

(22) Filed: Jun. 23, 2000

(30) Foreign Application Priority Data

Jun. 25, 1999 (GB) ..... 9914791
Jul. 17, 1999 (GB) ..... 9916710
Aug. 12, 1999 (GB) ..... 9918899

(51) Int. Cl.[7] ..... B05B 1/14
(52) U.S. Cl. ..... 239/533.12; 239/533.3; 239/533.8; 239/88; 239/91
(58) Field of Search ..... 239/88–92, 533.2–533.12; 123/293, 299, 496, 446

(56) References Cited

U.S. PATENT DOCUMENTS 3,612,407 A * 10/1971 Itano ..... 239/533.2
4,151,958 A * 5/1979 Hofmann ..... 239/533.3
4,269,360 A * 5/1981 Kopse ..... 239/533.8
4,339,080 A * 7/1982 Kopse ..... 239/533.3
4,758,169 A * 7/1988 Steiger ..... 239/533.5
5,458,292 A * 10/1995 Hapeman ..... 239/533.4
5,588,412 A * 12/1996 Nozaki ..... 123/496
5,645,225 A * 7/1997 Hasegawa ..... 239/533.12
5,765,755 A * 6/1998 Peters ..... 239/533.4
5,899,389 A * 5/1999 Pataki et al. ..... 239/533.2
6,189,817 B1 * 2/2001 Lambert ..... 239/533.12
6,257,507 B1 * 7/2001 Morell et al. ..... 239/533.2
6,260,775 B1 * 7/2001 Lambert et al. ..... 239/533.3

FOREIGN PATENT DOCUMENTS

EP 0967382 * 12/1999
EP 1063416 * 12/2000
EP 1063417 * 12/2000

* cited by examiner

*Primary Examiner*—Lesley D. Morris
*Assistant Examiner*—Dinh Q. Nguyen
(74) *Attorney, Agent, or Firm*—Thomas N. Twomey

(57) ABSTRACT

A fuel injector comprising a nozzle body provided with first and second outlet openings for fuel, a valve needle slidable within a valve needle bore defined in the nozzle body, the valve needle bore being shaped to define a seating with which the valve needle is engageable to control fuel flow to a chamber, the valve needle being provided with a flow passage communicating with the chamber, movement of the valve needle away from the seating into a first fuel injecting position permitting fuel delivery through the first outlet opening and whereby movement of the valve needle away from the seating into a second fuel injecting position causes fuel in the chamber to flow through the flow passage for delivery through the second outlet opening. The nozzle body may include an upper nozzle body part provided with a through bore and a lower nozzle body part provided with a blind bore, the lower nozzle body part being received in the through bore to close an open end thereof.

24 Claims, 21 Drawing Sheets

FUEL INJECTOR

TECHNICAL FIELD

This invention relates to a fuel injector intended for use in delivering fuel under pressure to a combustion space of a compression ignition internal combustion engine. The invention relates, in particular, to an injector of the inwardly opening type in which the number of outlet openings through which fuel is injected at any instant can be controlled by controlling the position of a valve needle.

BACKGROUND OF THE INVENTION

It is desirable to guide the end of the needle adjacent the outlet openings of the injector for sliding movement so that the needle remains substantially concentric with its seating when lifted from the seating. It is a first object of the present invention to provide a fuel injector of the type described hereinbefore in which the end of the needle is guided.

In order to reduce the levels of noise and particulate emissions produced by an engine it is desirable to provide an arrangement whereby the rate at which fuel is delivered to the engine can be controlled. It is also desirable to be able to adjust other injection characteristics, for example the spray pattern formed by the delivery of fuel by an injector. British Patent Application GB 2 307 007 A and European Patent Application EP 0 713 004 A both describe fuel injectors of the type in which the fuel injection characteristic can be varied, in use, by selecting different sets of fuel injector outlet openings formed in the fuel injector nozzle body. In both of these fuel injector designs, angular motion of a sleeve member, housed within the nozzle body, causes apertures formed in the sleeve to align with selected ones of the outlet openings and subsequent inward, axial motion of a valve member within the bore of the nozzle body causes fuel to be ejected from the selected outlet openings. In this way, the fuel injection characteristic can be varied, in use, by selecting different ones of the outlet openings. However, fuel injectors of this design suffer from the disadvantage that the are complex and expensive to manufacture, and have performance limitations.

British Patent Application No 9905231 describes a fuel injector including a nozzle body defining a bore within which an outwardly opening, outer valve member is slidable. Movement of the outer valve needle in an outward direction causes fuel to be ejected from an upper group of outlet openings provided in the outer valve needle. The outer valve needle defines a blind bore within which an inner valve member is slidable. Inward movement of the inner valve member causes fuel injection through a lower group of outlet openings provided in the outer valve needle. The fuel injection rate provided by the injector is controlled by means of an actuator arrangement which controls the downward force applied to the inner valve member. A disadvantage of this type of fuel injector is that, as the injector includes a valve needle of the outwardly opening type, a poor fuel spray characteristic is obtained as the outlet openings become exposed. In addition, leakage can occur from the outlet openings during undesirable stages of the fuel injection cycle.

It is a further object of the present invention to provide an alternative fuel injector which permits the fuel injection characteristic to be varied, in use, whilst alleviating at least one of the disadvantages of known fuel injectors having this capability.

SUMMARY OF THE INVENTION

According to a first aspect of the present invention there is provided a fuel injector comprising a nozzle body provided with first and second outlet openings for fuel, a valve needle slidable within a valve needle bore defined in the nozzle body, the valve needle bore being shaped to define a seating with which the valve needle is engageable to control fuel flow to a chamber, the valve needle being provided with a flow passage communicating with the chamber, movement of the valve needle away from the seating into a first fuel injecting position permitting fuel delivery through the first outlet opening and whereby movement of the valve needle away from the seating into a second fuel injecting position causes fuel in the chamber to flow through the flow passage for delivery through the second outlet opening.

The valve needle may have a surface shaped to define first and second sealing surfaces for the first and second outlet openings, whereby movement of the valve member away from the seating into the first fuel injecting position causes the first sealing surface to uncover the first outlet opening to permit fuel delivery therefrom and movement of the valve needle away from the seating into the second fuel injecting position causes the second sealing surface to uncover the second outlet opening to permit fuel delivery therefrom. The surface of the valve needle may be shaped such that the second sealing surface closes the first outlet opening in the second fuel injecting position to prevent fuel delivery therefrom. Alternatively, the valve needle may be shaped such that fuel delivery occurs through both the first and second outlet openings when the fuel injector is in the second fuel injecting position. The valve needle may be provided with a surface which is slidable over a guide surface to guide the valve needle for sliding movement within the valve needle bore.

The guide surface may be defined by a portion of the valve needle bore located downstream of the chamber. The guide surface may be defined by a guide member carried by the nozzle body.

The flow passage may be provided, at least in part, within the guide member. The flow passage may be arranged to open into an annular groove which is communicable with the second outlet opening.

The valve needle may be provided with a first annular recess communicating with the first outlet opening, whereby, in use, movement of the valve needle into the first fuel injecting position causes the chamber to communicate with the first annular recess to permit fuel delivery through the first outlet opening.

In one embodiment of the invention, the valve needle may be provided with an additional flow passage such that movement of the valve needle away from the seating into the first fuel injecting position causes fuel in the chamber to flow into the first annular recess via the flow passage and the additional flow passage to permit fuel delivery through the first outlet opening. In one embodiment of the invention, the first annular recess may be arranged such that the first and second outlet openings are closed for a period of time when the fuel injector is between the first and second fuel injecting positions.

The valve needle may also be provided with a second annular recess communicating with the second outlet opening such that movement of the valve needle into the second fuel injecting position causes fuel in the chamber to flow into the second annular recess via the flow passage to permit fuel delivery through the second outlet opening. In one embodiment of the invention, the first annular recess may be arranged to permit fuel delivery through both the first and second outlet openings at the same time.

The valve needle may be provided with an axially extending bore which defines at least part of the flow passage for fuel. The axially extending bore provided in the valve needle may be a blind bore, the open end of the axially extending bore being sealed by a sealing member.

Alternatively, the flow passage may be defined by cross drillings provided in the valve needle or by flats, slots, flutes or grooves provided on the valve needle.

In one embodiment of the invention, the valve needle may comprise an upper part provided with an upper bore and a lower part provided with a lower bore, the lower part of the valve needle being received within the upper bore. The lower bore may be a blind bore. A two-part valve needle is advantageous as the fuel injector is easy to manufacture and assemble.

The nozzle body may be shaped to define a further seating, the lower part of the valve needle including an enlarged region defining a surface which is engageable with the further seating when the valve needle is lifted to the first fuel injecting position. In use, engagement between the surface and the further seating serves to prevent the leakage of fuel from the bore in the nozzle body.

The fuel injector may further comprise a plug member received within the lower bore to reduce the volume of the flow passage available for fuel.

Control of the fuel injector may be achieved conveniently by means of an actuator arrangement for moving the valve needle between the first and second fuel injecting positions. The fuel injector only requires a single valve needle and is therefore relatively easy to manufacture and assemble.

In one embodiment of the invention, the nozzle body may comprise an upper nozzle body part provided with a through bore and a lower nozzle body part provided with a blind bore, the lower nozzle body part being received in the through bore to close an open end thereof. The seating with which the valve needle is engageable may be defined by a part of the bore provided in the lower nozzle body part.

The first and second outlet openings may conveniently be provided in the lower nozzle body part.

According to a second aspect of the present invention, there is provided a fuel injector comprising a nozzle body provided with first and second outlet openings for fuel, a valve needle slidable within a valve needle bore defined in the nozzle body, the valve needle bore being shaped to define a seating with which the valve needle is engageable to control fuel flow to a chamber, the nozzle body including an upper nozzle body part provided with a through bore and a lower nozzle body part provided with a blind bore, the lower nozzle body part being received in the through bore to close an open end thereof.

BRIEF DESCRIPTION OF THE DRAWINGS

The invention will further be described, by way of example, with reference to the accompanying drawings, in which.

DESCRIPTION OF THE PREFERRED EMBODIMENT

Figure 1:
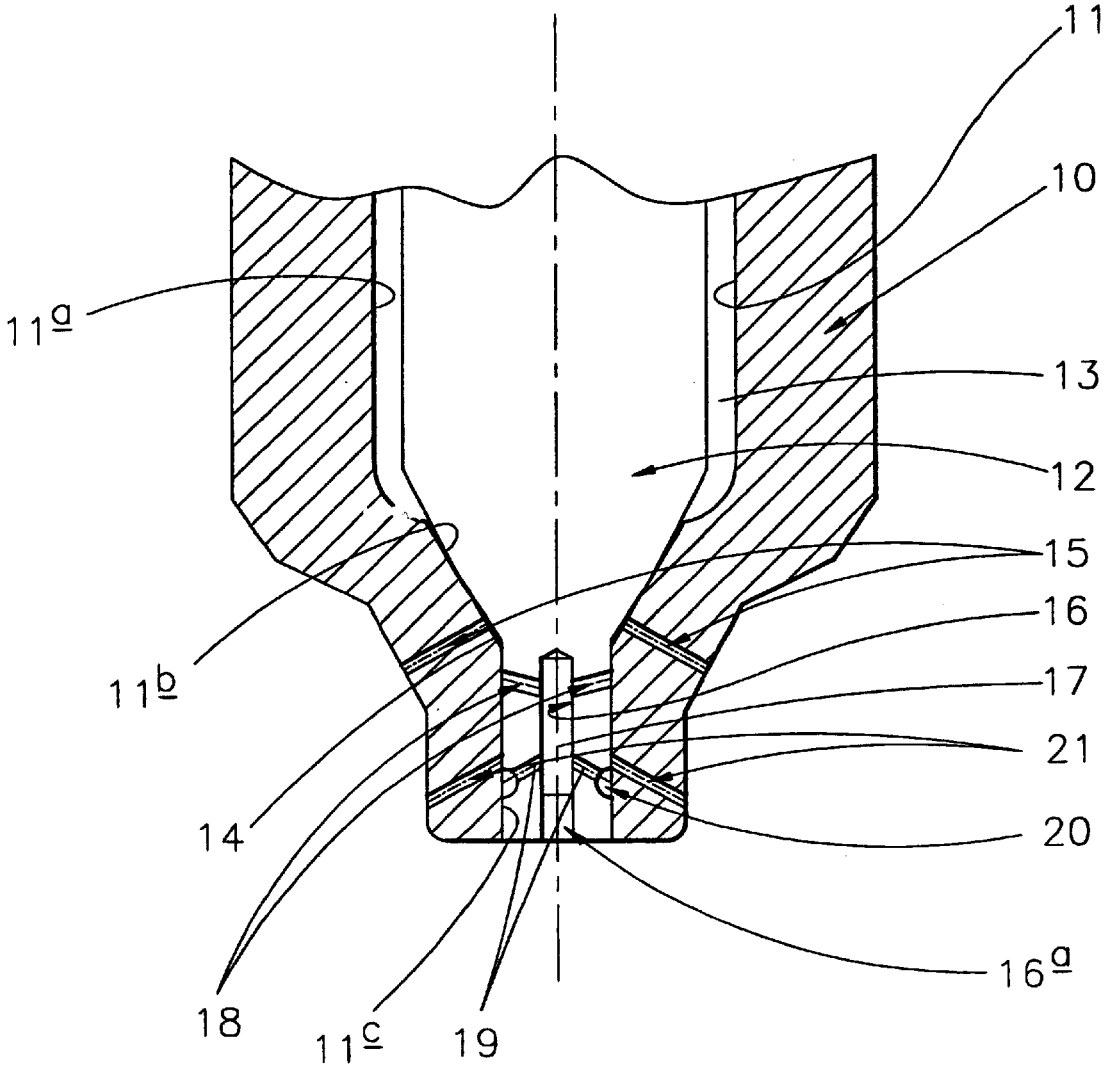
FIG. 1 is a sectional view illustrating part of a fuel injector in accordance with an embodiment of the invention.

The fuel injector illustrated, in part, in FIG. 1 comprises a nozzle body 10 which is provided with a through bore 11. The through bore 11 includes a region 11*a* of relatively large diameter, a frusto-conical region which forms a seating surface 11*b*, and downstream of the frusto-conical region, a region 11*c* of relatively small diameter. Slidable within the bore 11 is a valve needle 12. The valve needle 12 includes, at an upper end thereof (not shown), a region of diameter substantially equal to the diameter of the adjacent part of the bore 11 which serves to guide the upper end of the needle 12 for sliding movement within the bore 11. The needle 12 further includes, at its lowermost end in the orientation illustrated, a region of diameter substantially equal to the diameter of the region 11*c*. The wall of the bore 11 defining the region 11*c* acts as a guide surface, guiding the lower end of the needle 12 for sliding movement within the bore 11. As the needle 12 is guided for sliding movement at both its upper and lower ends, it will be appreciated that, throughout the range of sliding movement of the needle 12, the needle 12 can be held substantially coaxially within the bore 11, the needle 12 remaining concentric with the frusto-conical seating surface 11*b*.

The needle 12 includes a region which is engageable with the seating 11*b* to control communication between a delivery chamber 13 defined between the needle 12 and the bore 11 upstream of the seating and a chamber 14 located downstream of the seating 11*b*. The chamber 14 communicates with a plurality of first outlet openings 15, two of which are illustrated in FIG. 1.

The needle 12 is provided with an axially extending blind drilling 16 which defines a flow passage 17 for fuel, the lowermost end of the drilling 16 being closed by means of a plug 16*a*. The drilling 16 communicates with a pair of drillings 18 which are located such that, when the needle 12 engages the seating 11*b* the drillings 18 are located within the region 11*c* of the bore 11 and are closed by the nozzle body 10, and in particular by the guide surface, thus the drillings 18 do not communicate with the chamber 14. The drilling 16 further communicates with a pair of drillings 19 which open into an annular groove 20 formed in the valve needle 12. The annular groove 20 is located such that, upon movement of the needle 12 away from the seating 11*b* by a predetermined distance, the annular groove 20 moves to a position in which it communicates with a plurality of second outlet openings 21 (two of which are shown) provided in the nozzle body 10. Then the needles 12 engages the seating surface 11*b*, the annular groove 20 occupies a position in which it does not communicate with the second outlet openings 21.

In use, the bore 11 is supplied with fuel from a source of fuel at high pressure (not shown), for example a common rail of a common rail fuel system, the common rail being arranged to be charged to a suitably high pressure by an appropriate high pressure fuel pump. Any suitable technique may be used to control movement of the needle 12. For example, the needle 12 may be spring biased towards the seating 11*b*, movement of the needle 12 away from this position occurring when the fuel pressure within the bore 11 applied to angled thrust surfaces of the needle 12 exceeds a predetermined level. Alternatively, the bore 11 may be supplied continuously with fuel at high pressure, and an appropriate actuator arrangement, conveniently a piezoelectric or electromagnetic actuator arrangement, may be used to control movement of the needle 12.

Regardless as to the manner in which the position of the valve needle 12 is controlled, where the valve needle 12 engages the seating 11*b*, fuel within the bore 11 is unable to flow to the chamber 14, and hence is unable to reach either the first or second outlet openings 15, 21. Fuel injection does not, therefore, take place.

When fuel injection is to commence, the needle 12 is moved away from the seating 11*b*. Provided the distance through which the needle 12 is moved which is insufficient to cause the drillings 18 to move to a position in which they communicate with the chamber 14, then fuel will be delivered through only the first outlet openings 15, fuel being unable to flow through the flow passage defined by the drillings 18, 16, 19 to the second outlet openings 21. The fit of the needle 12 within the region 11*c* of the bore 11 is substantially fluid tight, thus fuel is only injected through the first outlet openings 15. As mentioned hereinbefore, as the needle 12 is guided both at its upper end and at its lower end, it will be appreciated that during this phase of the operation of the injector, the needle 12 remains substantially coaxial with the bore 11.

When injection is to be terminated, the needle 12 is returned to the position illustrated in which it engages the seating 11*b*, thus terminating the supply of fuel to the chamber 14 and through the first outlet openings 15.

If desired, rather than terminate injection, the injection rate may be increased by moving the needle 12 away from the seating 11*b* by an increased distance, sufficient to cause the drillings 18 to move into communication with the chamber 14. Once this position has been reached, fuel is able to flow through the flow passage defined by the drillings 18, 16, 19, and through the annular groove 20 to the second outlet openings 21. It will be appreciated that, in such circumstances, fuel injection occurs through both the first and second outlet openings 15, 21. As fuel is delivered through an increased number of outlet openings, it will be appreciated that the fuel injection rate is increased.

As described hereinbefore, termination of injection occurs by moving the needle 12 into engagement with the seating surface to terminate the supply of fuel to the chamber 14, the movement also resulting in the flow passage moving out of communication with the chamber 14.

The movement of the needle 12 into engagement with the seating 11*b* also causes the annular groove 20 to move out of communication with the second outlet openings 21. It will be appreciated that the injection of fuel through these outlet openings terminates rapidly in a controlled manner as the supply of fuel thereto is cut off rapidly. In some applications, it may not be necessary to ensure that the termination of injection through the second outlet openings 21 occurs rapidly, and in such applications, the annular groove 20 may be of suitable dimensions to register with the second outlet openings 21 throughout the range of movement of the needle 12.

By appropriate control of the distance through which the valve needle 12 is moved, in use, the number of outlet openings through which fuel is delivered at any particular time can be selected, and appropriate selection of the number of outlet openings used at any particular time can be used to reduce the levels of particulate emissions and noise generated by the engine with which the injector is used. As mentioned hereinbefore, the needle 12 is guided for sliding movement within the bore 11 throughout the range of movement of the needle 12, thus the needle 12 remains substantially coaxial with the bore 11 at all times. As a result, fuel is distributed evenly to the first outlet openings 15, such an even distribution of fuel not necessarily occurring where the needle 12 is not held coaxial with the bore 11 during injection.

If desired, the injector may be modified to incorporate three or more groups of outlet openings, the number of outlet openings through which fuel is delivered at any particular time being determined by the distance through which the needle is moved. Alternatively, a third or further groups of openings may be provided and arranged such that, if movement of the needle away from the seating continues beyond the point at which the groove 20 registers with the openings 21, then the groove 20 may move to a position in which it communicates with the third or further groups of openings. This may be instead of or in addition to communication with the openings 21. By appropriate selection of the sizes of the openings and by appropriate control of the distance moved by the needle, improved control over the fuel injection characteristics can be achieved.

Figure 2:
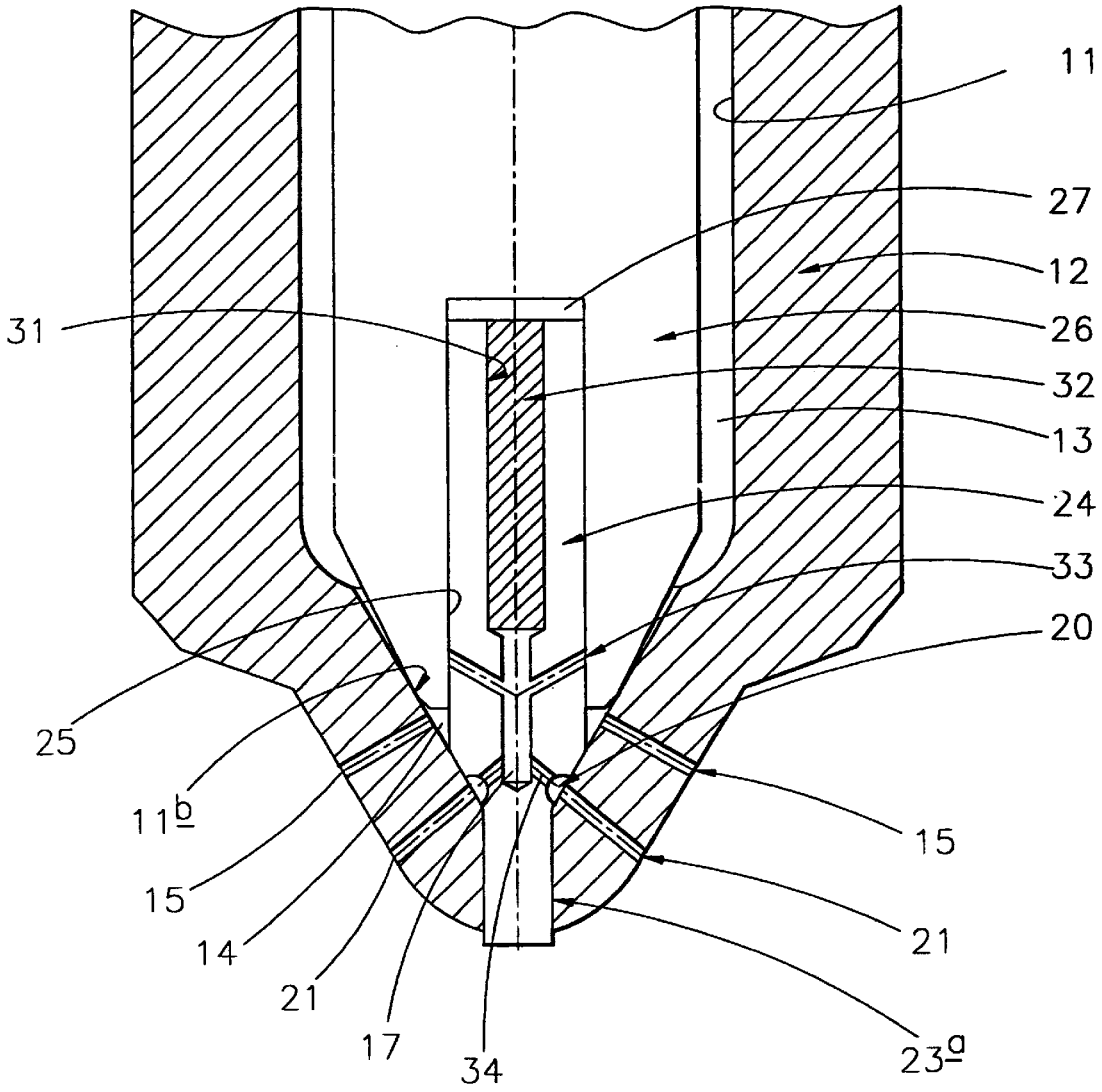
FIG. 2 is a view illustrating part of a second embodiment of the fuel injector of the present invention.

An alternative embodiment is illustrated in FIG. 2. In the arrangement of FIG. 2, the nozzle body 10 is provided with a bore 11 of form similar to the bore of the arrangement illustrated in FIG. 1. The arrangement of FIG. 2 differs from that of FIG. 1 in that a guide member 24 is rigidly secured within the bore 11, the guide member 24 being an interference fit with a lowermost end region 23*a* of the bore 11. The guide member 24 is received, in part, within a blind bore 25 formed in a valve needle 12, the bore 25 being of external diameter substantially equal to the diameter of the adjacent part of the guide member 24. A small clearance is formed between the closed end of the bore 25 and the upper end of the guide member 24, the clearance defining a chamber 27 of small volume.

As in the embodiment shown in FIG. 1, the bore 11 defines a frusto-conical seating 11*b* with which the valve needle 12 is engageable to control communication between the delivery chamber 13 and the chamber 14 located downstream of the seating 11*b*. A plurality of first outlet openings 15 communicate with the chamber 14.

The guide member 24 defines, at its outer surface, a guide surface which engages the wall of the bore 25 to guide the lower end of the needle 12 for sliding movement within the bore 11, ensuring that the needle 12 remains substantially coaxial with the bore 11 throughout the range of movement of the needle 12. The guide member 24 is provided with an axially extending blind drilling 31, the upper end of which is closed by means of a plug 32. Drillings 33 communicate with the passage 17, the drillings 33 being located such that, when the needle 12 engages the seating 11*b*, the drillings 33 are covered by the wall of the bore 25 provided in the needle 12, and thus are closed, a substantially fluid tight seal being formed between the needle 12 and the guide member 24, ensuring that communication is not permitted between the chamber 14 and the drillings 33. Further drillings 34 communicate with the passage 17, the drillings 34 opening into the annular groove 20 provided in the exterior of the guide member 24 and located so as to communicate with the second outlet openings 21.

In use, fuel under pressure is applied to the bore 11 and movement of the valve needle 12 is controlled using any suitable technique as mentioned hereinbefore with reference to FIG. 1. When the valve needle 12 engages the seating 11*b* as illustrated, fuel is unable to flow to the chamber 14. In this position, injection of fuel does not take place through either the first outlet openings 15 or the second outlet openings 21. Movement of the needle 12 away from the seating 11*b* by a small amount (less than distance A illustrated in FIG. 2) results in fuel being able to flow to the chamber 14, thus fuel is delivered through the first outlet openings 15. As the movement of the needle 12 does not result in communication being established between the drillings 33 and the chamber 14, fuel is unable to flow through the passage 17 to the second outlet openings 21. Fuel is therefore delivered only through the first outlet openings 15 and fuel injection occurs at a relatively low rate. Fuel injection may be terminated, if desired, by returning the needle 12 to the position shown to terminate the supply of fuel to the chamber 14 and first outlet openings 15.

Rather than terminate injection, the needle 12 may be lifted away from the seating surface by an increased amount, greater than distance A, resulting in communication being established between the chamber 14 and the drillings 33. As a result, fuel is able to flow from the chamber 14 through the passage 17 and the drillings 33, 34 and through the annular groove 20 to the second outlet openings 21. As a result, fuel is delivered through both the first and second outlet openings 15, 21 and fuel is injected at an increased rate. Fuel injection is terminated, when desired, by returning the needle 12 to the position illustrated to terminate the supply of fuel to the chamber 14, terminating the supply of fuel to all of the outlet openings.

As a substantially fluid tight seal is formed between the guide member 24 and the needle 12, it will be appreciated that the chamber 27 is substantially isolated. As a result of movement of the needle 12 away from the seating surface, the volume of the chamber 27 increases reducing the fuel pressure therein. Although this reduction in fuel pressure will tend to hinder movement of the needle 12 away from its seating surface, as the volume of the chamber 27 is relatively small and the effective areas exposed to the fuel pressure therein are small, these forces will not have a significant effect upon the operation of the injector. Further, a small amount of leakage between the guide member 24 and the needle 12 is likely to occur, such leakage tending to balance the fuel pressure within the chamber 27, further reducing the effect of the changes in the volume of the chamber 27 upon the operation of the injector. As such leakage occurs, the pressure within the chamber 27 will increase to match the pressure within the delivery chamber 13, thus as the injector operates, the effect of the chamber 27 being closed will reduce.

As with the embodiment of FIG. 1, the arrangement of FIG. 2 has the advantages that the needle 12 is guided for sliding movement within the bore 11 throughout its range of movement thus the needle 12 remains substantially concentric with the seating surface.

If desired, the arrangement of FIG. 2 may be modified to include three or more groups of outlet openings, the number of groups of outlet openings through which fuel is delivered at any instant being governed by the distance through which the needle 12 is lifted from its seating.

FIGS. 3 to 6 illustrate an alternative embodiment of the invention, in which similar parts to those shown in FIGS. 1 and 2 are denoted with like reference numerals and will not be described in further detail hereinafter. The bore 11 provided in the nozzle body 10 is a blind bore and includes an intermediate region 11*a* a frusto-conical region which forms a seating 11*b* a region 11*c* of relatively small diameter located downstream of the frusto-conical region and an upper end region 11*d* of relatively large diameter. The valve needle 12 includes, at an upper end thereof, a region 12*c* having a diameter substantially equal to the diameter of the adjacent part of the bore 11d such that the region of the bore 11*d* guides the upper end 12*c* of the needle 12 for sliding movement within the bore 11. The valve needle 12 further includes, at its lowermost end in the orientation illustrated, a valve needle region 12*b* of reduced diameter, the diameter of the valve needle region 12*b* being substantially equal to the diameter of the bore region 11*c*. The wall of the bore 11 defining the bore region 11*c* acts as a guide surface which also serves to guide the lower, valve needle region 12*b* of the valve needle 12 for sliding movement within the bore 11. As the needle 12 is guided for sliding movement at both its upper and lower ends, it will be appreciated that, throughout the range of sliding movement of the needle 12, the needle 12 can be held substantially coaxially within the bore 11, the needle 12 remaining concentric with the frusto-conical seating 11*b*.

The valve needle 12 includes a region which is engageable with the seating surface 11*b* to control communication between the delivery chamber 13 and the chamber 14 located downstream of the seating 11*b*.

In this embodiment of the invention, the passage 17 defined by the axially extending drilling 16 provided in the valve needle 12 communicates with the chamber 14 by means of cross drillings 18 provided in the valve needle region 12*b*. The passage 17 also communicates with a sac region 22 located at the blind end of the bore 11.

The valve needle region 12*b* is provided with first and second annular recesses or grooves 50,52 respectively, the surface of the valve needle region 12*b* also defining first and second sealing surfaces 54,56 for the first and second set of outlet openings 15,21 respectively. With the valve needle 12 adopting the position shown in FIGS. 3 and 4, the first annular recess 50 cooperates with the adjacent part of the bore region 11*c* to define an enclosed chamber with the first set of outlet openings 15 being closed by the first sealing surface 54. Thus, with the valve needle in this position, the enclosed chamber defined by the recess 50 and the bore region 11*c*, does not communicate with either the first set of outlet openings 15 or the chamber 14. The second annular recess 52 communicates with the sac region 22 but does not communicate with the second outlet openings 21, the second outlet openings being closed by the second sealing surface 56 defined by the surface of the valve needle region 12*b*.

At the end of the nozzle body 10 remote from the blind end of the bore 11, there is provided an annular gallery 60 which communicates with the bore 11 and a supply passage 62 provided in the nozzle body 10. The supply passage 62 communicates with a source of fuel at high pressure, as described previously, such that high pressure fuel can be introduced into the annular gallery 60 and, thus, delivered to downstream parts of the fuel injector. The valve needle 12 may be spring biased towards the seating surface 11*b*, movement of the valve needle 12 away from this position occurring when the fuel pressure within the bore 11 applied to angled thrust surfaces of the valve needle 12 exceeds a predetermined level. Alternatively, the bore 11 may be supplied continuously with fuel at high pressure, and an appropriate actuator arrangement, conveniently a piezoelectric actuator arrangement, used to control movement of the needle 12.

Figure 3:
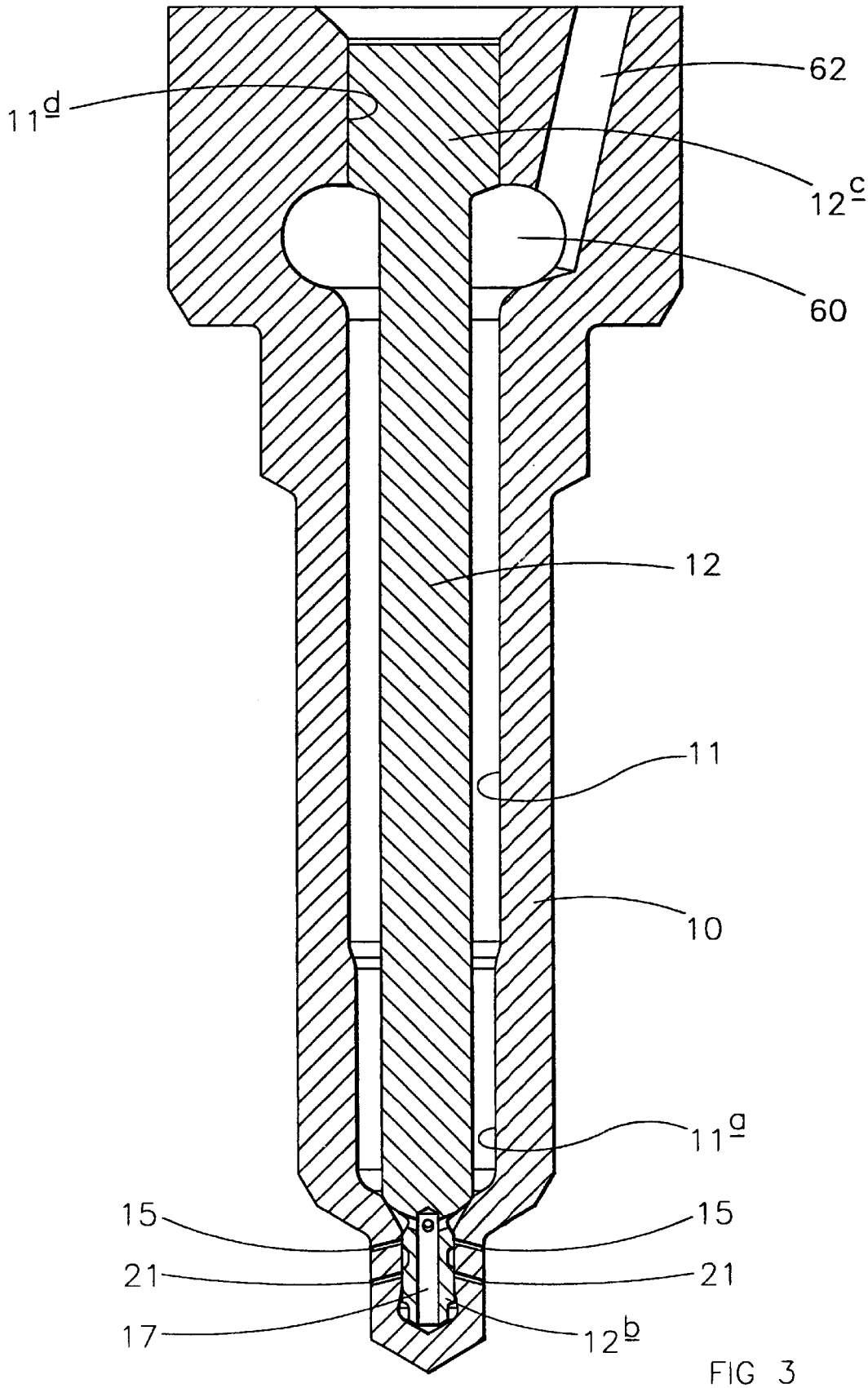
FIG. 3 is a sectional view illustrating a third embodiment of the fuel injector of the present invention.
Figure 4:
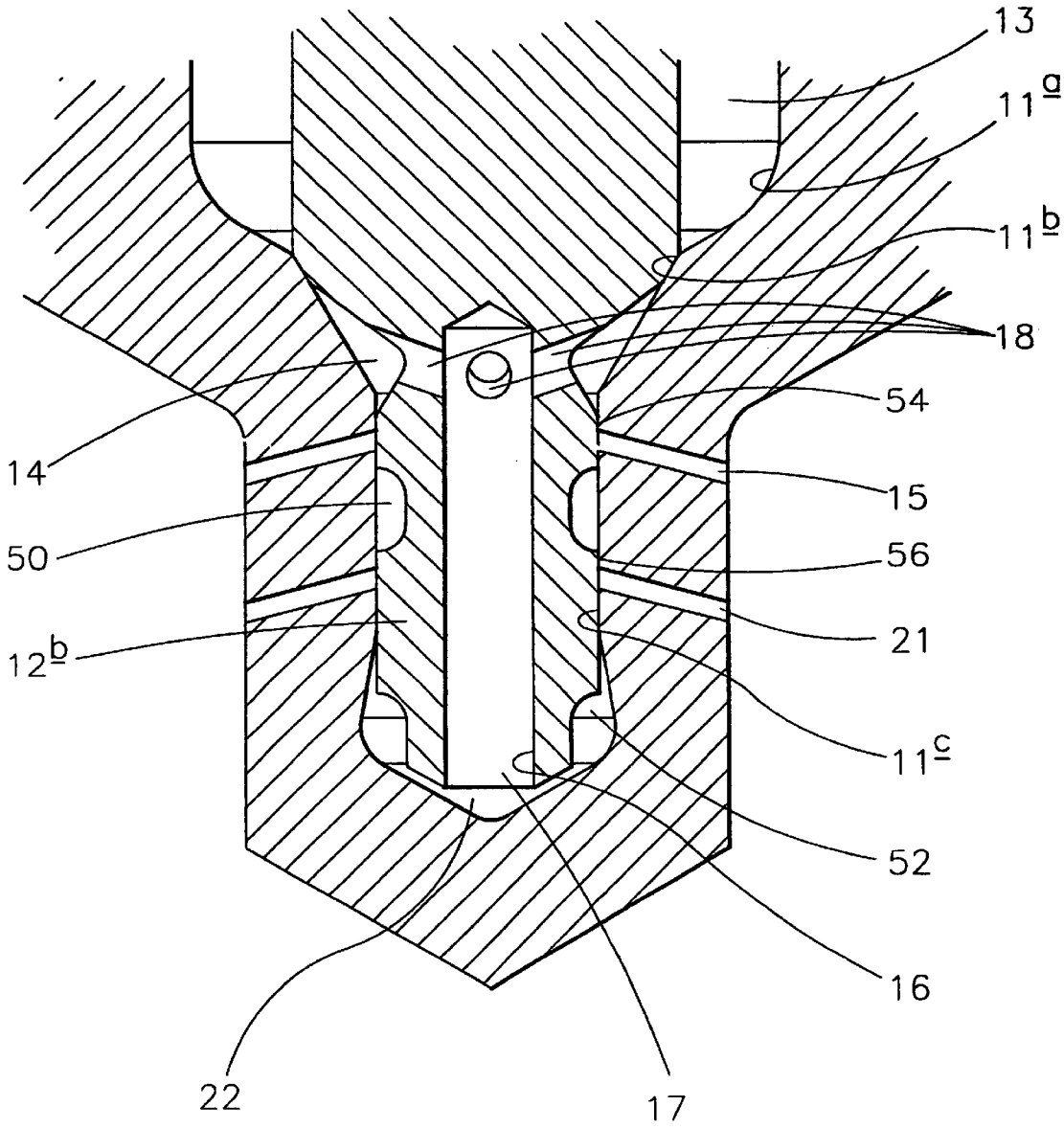
FIG. 4 is an enlarged view of a part of the fuel injector shown in FIG. 3.

In use, starting from the position shown in FIGS. 3 and 4, high pressure fuel is supplied through the supply passage 62, into the annular gallery 60 and, thus, into the delivery chamber 13. With the valve needle 12 seated against the seating 11*b*, fuel in the delivery chamber 13 is unable to flow past the seating 11*b* into the chamber 14. Thus, fuel injection does not occur through either the first or second set of outlet openings 15,21.

Figure 5:
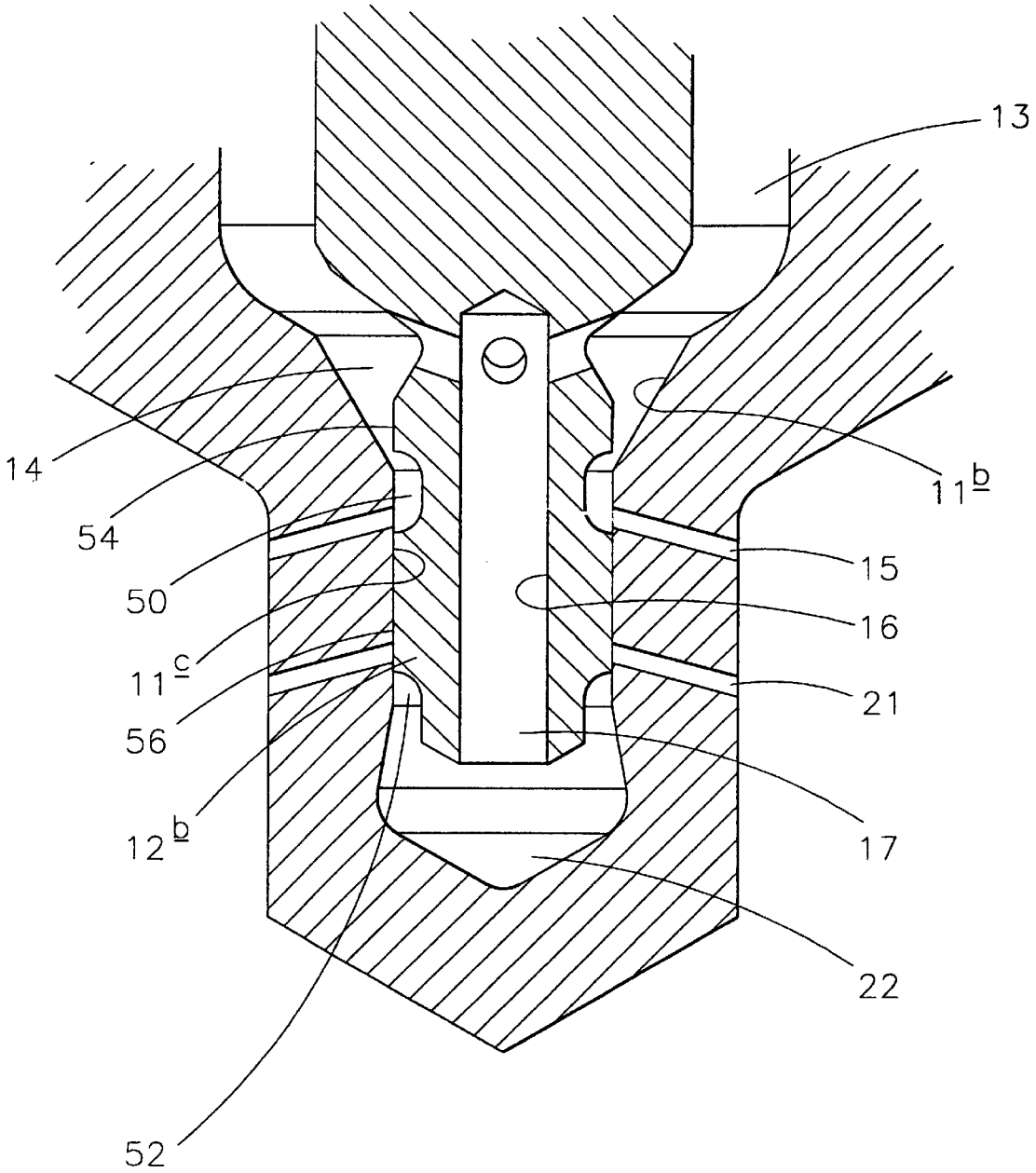
FIG. 5 is an enlarged view of the part of the fuel injector shown in FIG. 4 when in a first fuel injecting position.

When fuel injection is to be commenced, the valve needle 12 is lifted away from the seating 11*b* into a first fuel injecting position, as shown in FIG. 5, such that fuel in the delivery chamber 13 is able to flow past the seating 11*b* into the chamber 14. During this stage of operation, the valve needle 12 is lifted away from the seating 11*b* by an amount which is sufficient to bring the annular recess 50 into communication with both the chamber 14 and the first set of outlet openings 15, the movement of the needle 12 resulting in the first outlet openings 15 no longer being covered by the first sealing surface 54. Thus, fuel flowing past the seating 11*b* into the chamber 14 is able to flow into the annular recess 50 and out through the first outlet openings 15. Fuel in the chamber 14 is also able to flow through the drillings 18 into the passage 17 defined within the valve needle region 12*b* and into the sac region 22. However, with the valve needle 12 in the first fuel injecting position, the second outlet openings 21 remain closed by the second sealing surface 56. Thus, fuel within the sac region 22 and the annular recess 52 is not delivered through the second outlet openings 21. It will therefore be appreciated that, in the first fuel injecting position shown in FIG. 5, fuel injection occurs only through the first set of outlet openings 15.

From the position shown in FIG. 5, fuel injection may be terminated by returning the valve needle 12 to its seated position against the seating 11*b*. Thus, fuel is no longer able to flow from the delivery chamber 13 into the chamber 14 and out through the first outlet opening 15. Referring to FIG. 5, it will be appreciated that fuel injection will cease when the valve needle 12 is returned to its seated position and the sealing surface 54 cooperates with the bore 11*c* to break the communication between the chamber 14 and the first set of outlet openings 15.

Figure 6:
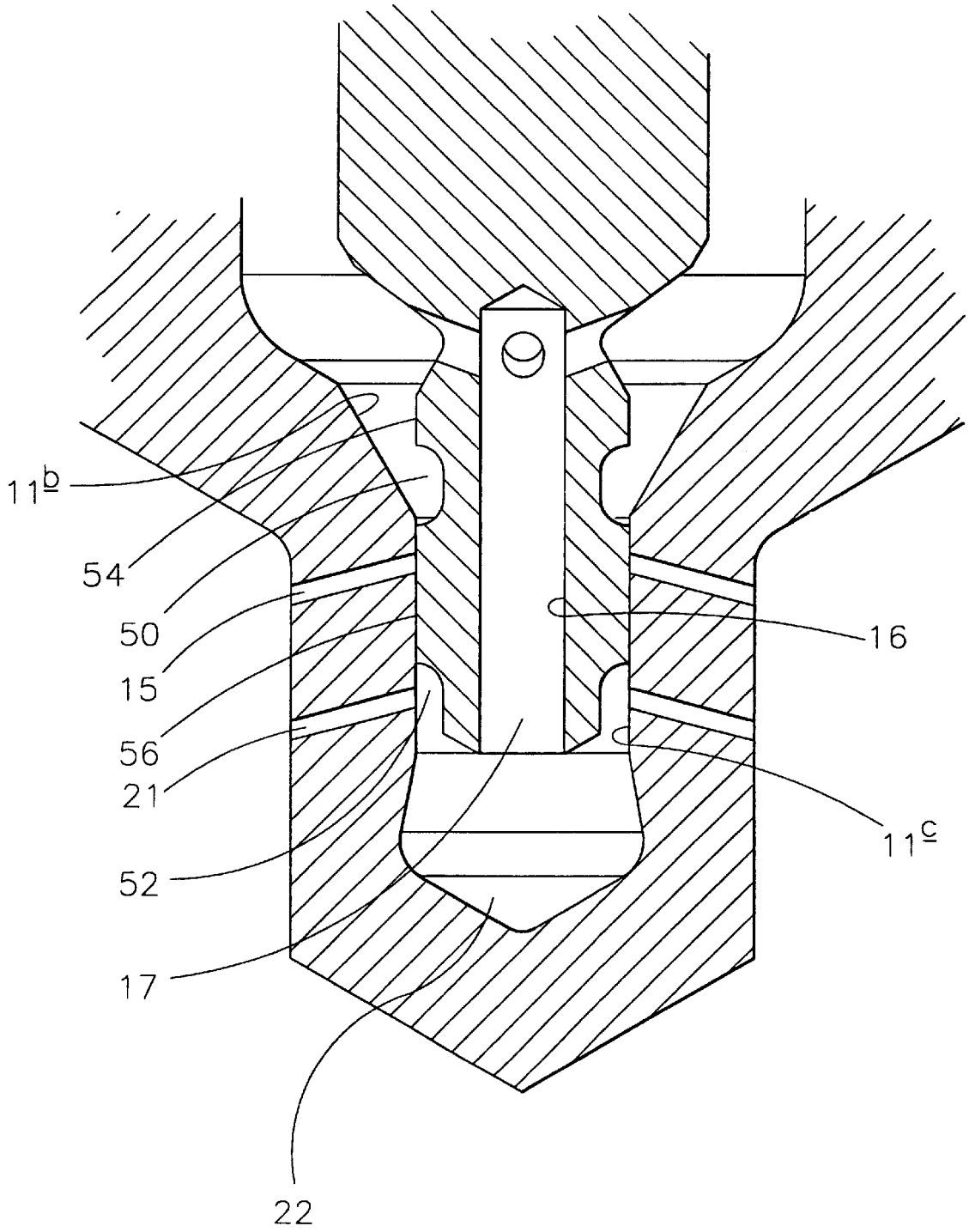
FIG. 6 is an enlarged view of the part of the fuel injector shown in FIG. 4 when in a second fuel injecting position.

Alternatively, from the position shown in FIG. 5, if fuel injection is required through the second outlet opening 21, the valve needle 12 is lifted by a further amount away from the seating 11*b* into a second fuel injecting position, as shown in FIG. 6. During this stage of operation, the valve needle 12 is lifted into a position in which the annular recess 50 communicates with the chamber 14 but in which the first set of outlet openings 15 are closed by the second sealing surface 56. Thus, although fuel in the delivery chamber 13 is able to flow past the seating 11*b* into the chamber 14 and into the annular recess 50, it is unable to flow through the first set of outlet openings 15. In addition, in the second fuel injecting position, the annular recess 52 is brought into communication with the second set of outlet openings 21. Thus, fuel within the delivery chamber 13 is able to flow through the drillings 18 and the passage 17, into the sac region 22 and is delivered, via the annular recess 52, through the second set of outlet openings 21. Thus, during this stage of operation, fuel injection only occurs through the second set of outlet openings 21. It will be appreciated that although fuel is able to flow into the passage 17 as soon as the valve needle 12 is lifted away from the seating 11*b*, fuel injection will only occur through the second set of outlet openings 21 when the valve needle 12 has been lifted by a sufficient amount to uncover the second outlet openings 21 and bring the annular recess 52 into communication therewith. The fuel injector shown in FIGS. 3 to 6 is therefore capable of delivering fuel through two different sets of outlet openings by moving the valve needle 12 inwardly between first and second fuel injecting positions.

From the position shown in FIG. 6, in order to cease fuel injection the valve needle 12 is returned to the position shown in FIGS. 3 and 4 such that the valve needle 12 engages the seating 11*b* and the first and second sealing surfaces 54,56 cover the first and second outlet openings 15,21 respectively.

Figure 7:
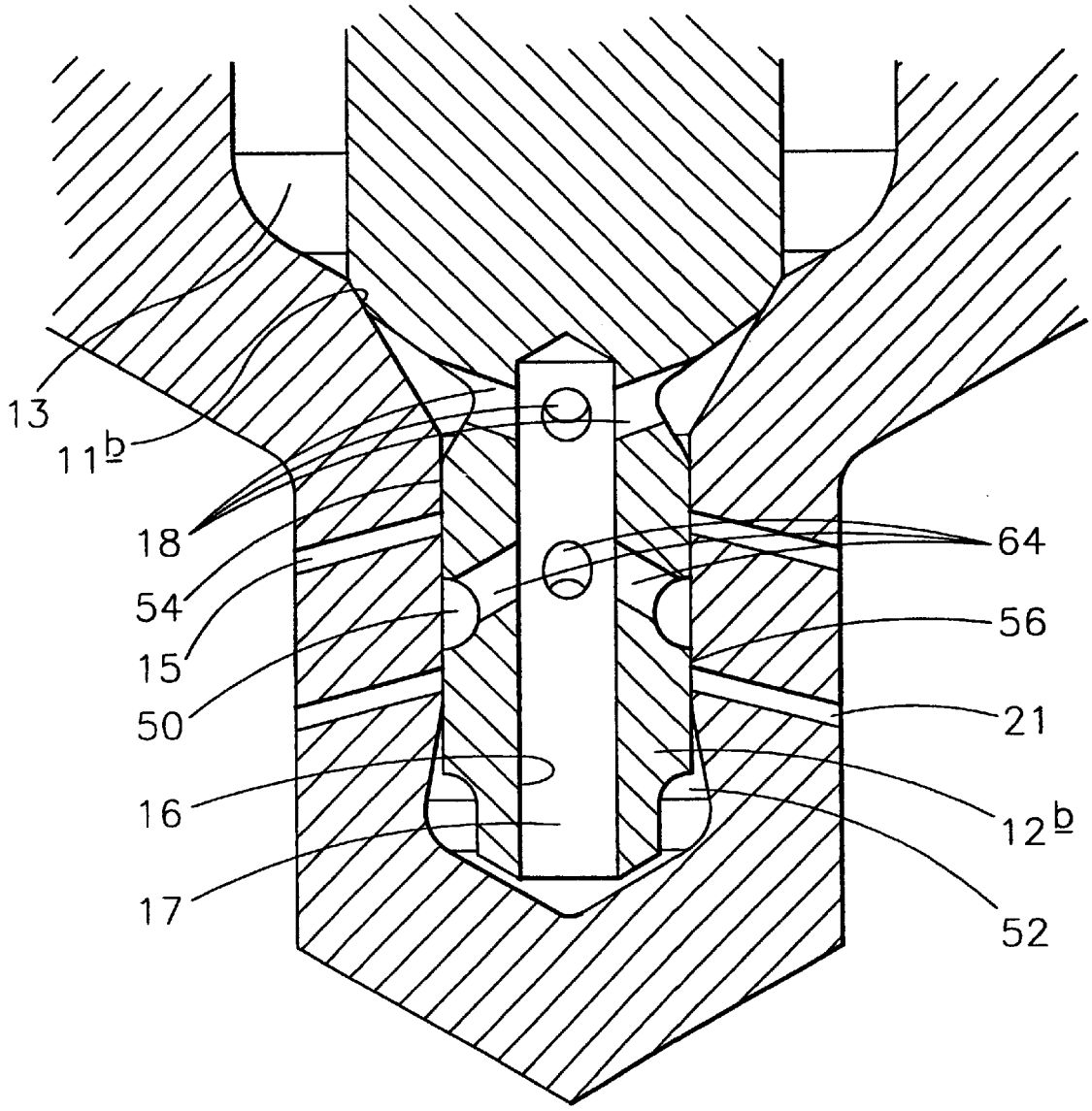
FIG. 7 is an enlarged sectional view of a part of a fourth embodiment of the fuel injector of the present invention.

FIG. 7 is a further alternative embodiment to those shown in FIGS. 1 to 6 with like reference numerals denoting similar parts to those shown in FIGS. 1 to 6. Referring to FIG. 7, the valve needle region 12*b* is provided with additional drillings 64 which communicate, at one end, with the passage 17 and, at the other end, with the annular recess 50. With the valve needle 12 seated against the seating 11*b*, fuel injection does not take place through either the first or second outlet openings 15,21, as described previously. In order to commence fuel injection, the valve needle 12 is lifted away from the seating to deliver fuel from a selected one of the first or second outlet openings 15,21, as shown in FIGS. 8 and 9 respectively, depending on the extent of movement of the valve needle 12 away from the seating 11*b*.

Figure 8:
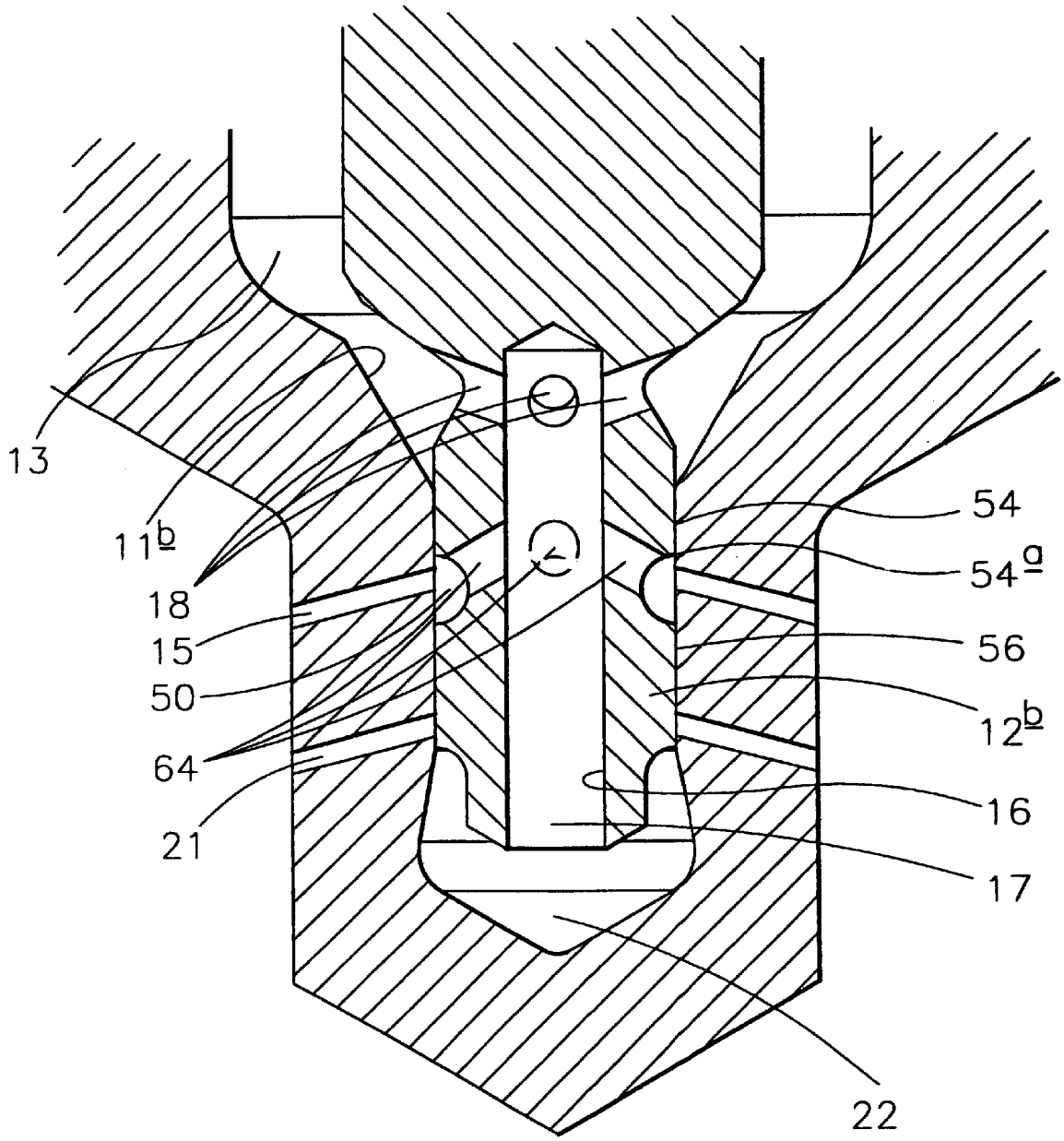
FIG. 8 is an enlarged view of the part of the fuel injector shown in FIG. 7 when in a first fuel injecting position.
Figure 9:
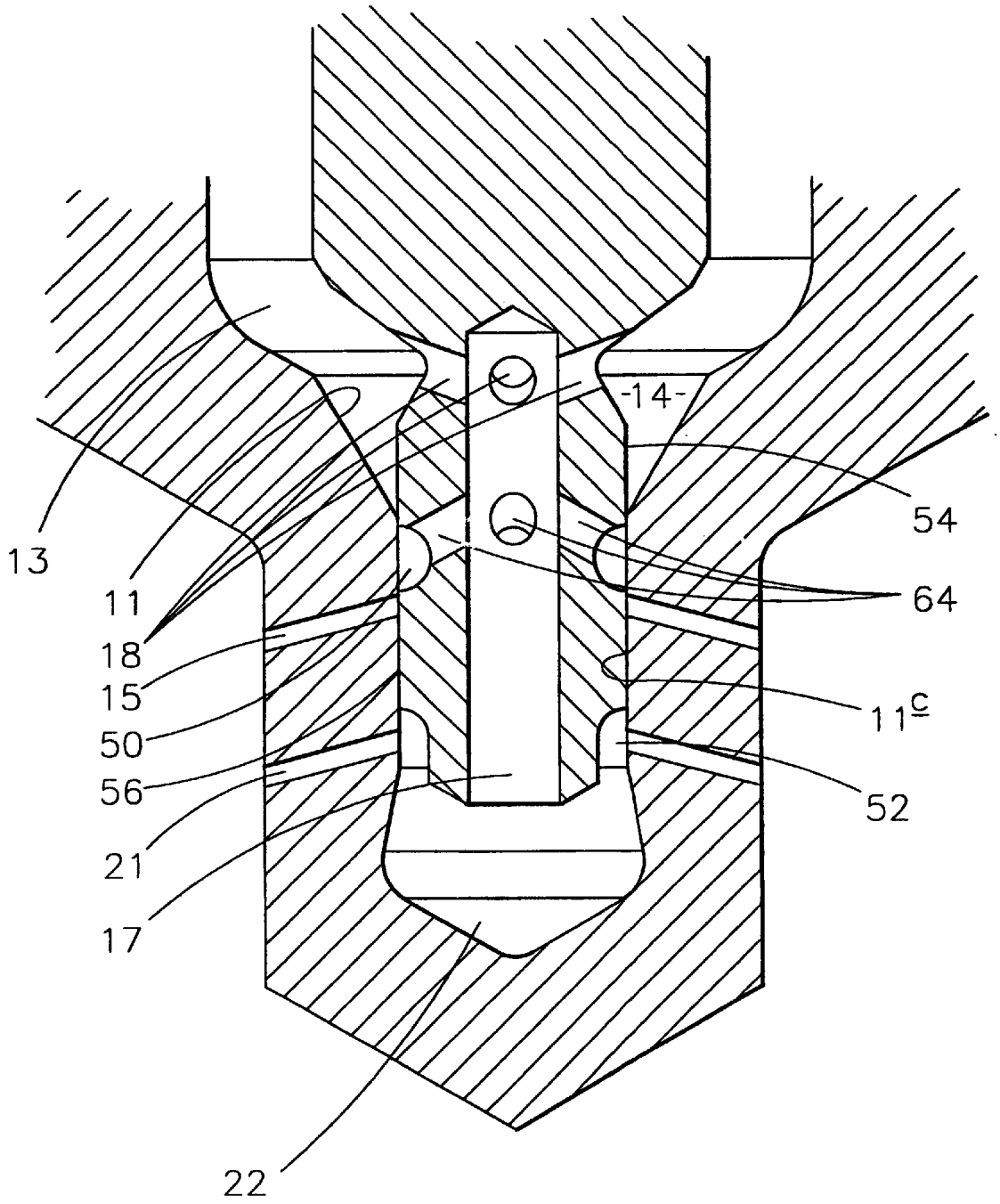
FIG. 9 is an enlarged view of the part of the fuel injector shown in FIG. 7 when in a second fuel injecting position.

Referring to FIG. 8, with high pressure fuel supplied to the delivery chamber 13 and with the valve needle 12 lifted away from the seating 11*b* into a first fuel injecting position, fuel is able to flow past the seating 11*b* into the drillings 18 and into the passage 17 in the valve needle region 12*b*. Fuel within the passage 17 is able to flow through drillings 64 into the annular recess 50 and out through the first outlet openings 15. However, fuel within the passage 17 which flows into the sac region 22 is unable to escape through the second set of outlet openings 21 which remain covered by the second sealing surface 56. Thus, during this stage of operation, fuel is only delivered through the first set of outlet openings 15.

From the position shown in FIG. 8, if fuel injection is to be ceased the valve needle 12 is returned to its seated position, as shown in FIG. 7, so that fuel is unable to flow past the seating 11*b* into the passage 17. Alternatively, referring to FIG. 9, in order to deliver fuel through the second set of outlet openings 21, the valve needle 12 is lifted away from the seating 11*b* by a further amount into a second fuel injecting position in which the second outlet openings 21 are uncovered by the sealing surfaces 56 and communicate with the second annular recess 52. Fuel is therefore delivered through the second set of outlet openings 21. The annular recess 50 is arranged such that, with the fuel injector in the second fuel injecting position, the annular recess 50 cooperates with the adjacent part of the bore region 11*c* so as to form an enclosed chamber which does not communicate with the chamber 14 nor with the first outlet openings 15. Thus, any fuel in the drillings 64 is unable to escape through the first outlet openings 15. In this position the first set of outlet openings 15 are closed by the second sealing surface 56. Thus, in the second fuel injecting position fuel is only delivered through the second outlet openings 21.

From the second fuel injecting position, the valve needle 12 may be moved into the first fuel injecting position, in which fuel is delivered only through the first outlet openings 15 (as shown in FIG. 8), or may be returned to its seated position (as shown in FIG. 7) in which case fuel injection ceases.

The embodiment of the invention shown in FIGS. 7 to 9 provides the advantage that the valve needle 12 need only be lifted away from the seating 11*b* by a relatively small amount in order to commence fuel injection through the first set of outlet openings 15 as this now occurs as soon as the sealing surface 54 uncovers the first set of outlet openings 15 and the annular recess 50 is brought into communication with the first outlet openings 15. This is not the case in the embodiment shown in FIGS. 1 to 6 in which fuel injection through the first outlet openings 15 only occurs when the valve needle 12 has been moved by a sufficient amount to bring the annular recess 50 into communication with the first outlet openings 15 and also into communication with the chamber 14. In addition, the embodiment of the invention shown in FIGS. 7 to 9 provides the advantage that the edge 54*a* (as indicated in FIG. 8) of the sealing surface 54 defined by the annular recess 50 need not be withdrawn from the bore 11*c* in order to deliver fuel from the first set of outlet openings 15. As a result, the risk of the injector becoming jammed open is reduced.

Figure 10:
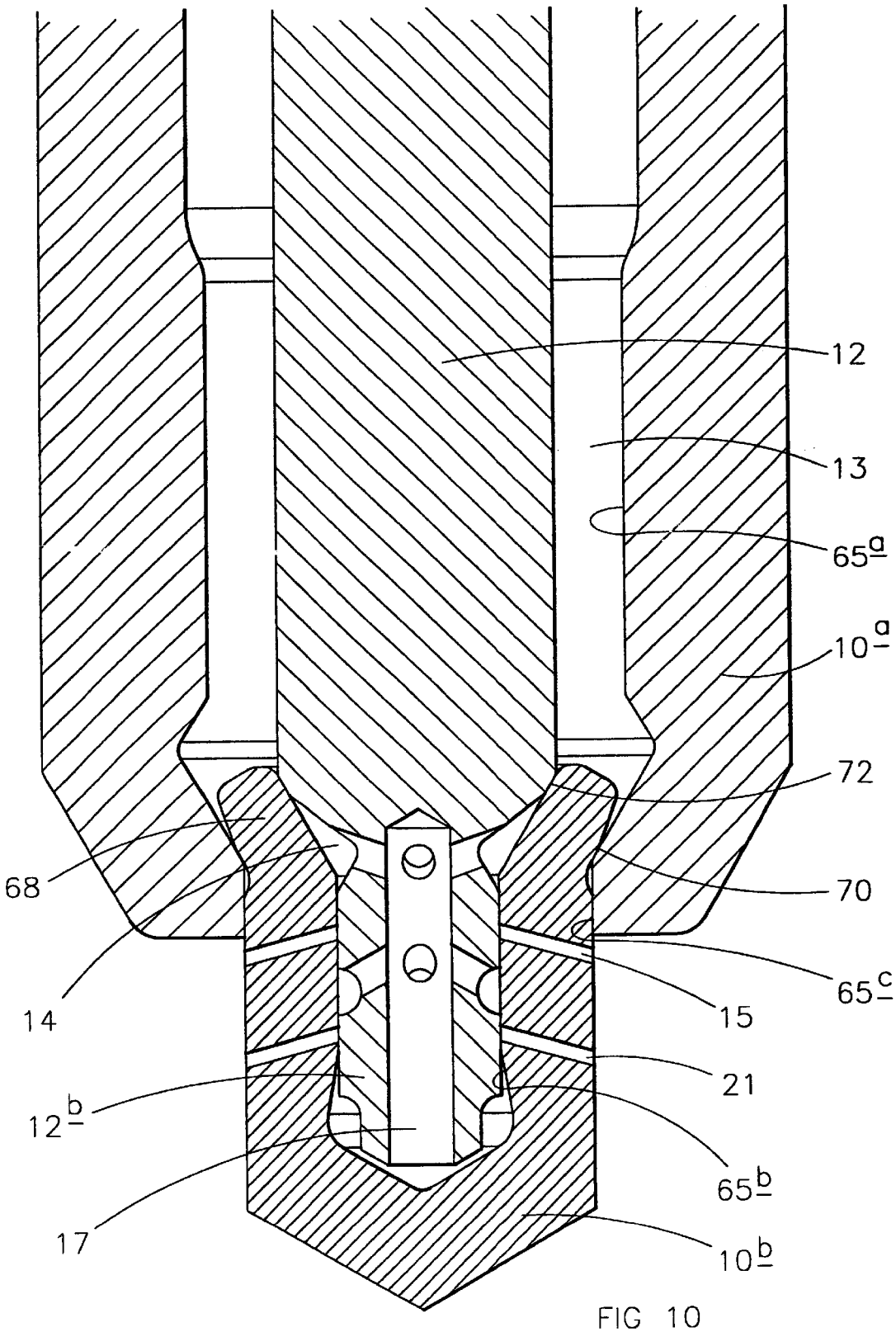
FIG. 10 is an enlarged view of a part of a fifth embodiment of the fuel injector of the present invention.

FIG. 10 shows a further alternative embodiment of the invention in which the nozzle body 10 is formed in two parts, an upper part 10*a* provided with a through bore 65*a* and a lower part 10*b* provided with a bore 65*b*. The through bore 65*a* includes a region of smaller diameter 65*c* at its open end, the lower part 10*b* being received within the open end and the outer diameter of the lower part 10*b* being substantially the same as the diameter of the bore region 65*c* such that the lower part 10*b* forms a close fit within the through bore 65*a*. The construction of the upper part 10*b* of the nozzle body at the end remote from the lower part 10*b* is the same as that described previously with reference to FIGS. 3 to 9.

At its end remote from the blind end of the bore 65*b*, the lower part 10*b* of the nozzle body 10 is provided with a winged portion 68, the outer surface of which cooperates with a seating 70, of substantially frusto conical form, defined by the bore 65*a*. The winged portion 68 also defines a frusto conical seating 72 with which the valve needle 12 is engageable to control fuel flow between the delivery chamber 13 and the chamber 14 downstream of the seating 72.

In use, with high pressure fuel supplied to the delivery chamber 13, fuel pressure within the delivery chamber 13 serves to maintain a substantially fluid-tight seal at the seating 70 between the upper and lower parts 10*a*, 10*b* of the nozzle body.

In order to ensure a substantially fluid-tight seal is maintained at the seating 70 it is important that the outer diameter of the winged portion 68 and the diameter of the adjacent part of the bore at the seating 70 are substantially the same and have good concentricity, and, in addition, that the outer diameter of the lower part 10*b* of the nozzle body and the diameter of the adjacent bore region 65*c* are substantially the same and have good concentricity. The concentricity requirements can be achieved during manufacture as the bore 65*a* can be shaped through the open end in which the lower part 10*b* of the nozzle body is to be received, the shaping being achieved in the same operation as the machining of the bore 65*a*. In addition, it is also important that the diameter of the seating 72 is less than that of the seating 70 as fuel pressure within the delivery chamber 13, and any additional loading in the upstream parts of the fuel injector, will force the lower part 10*b* of the nozzle body in a downwards direction.

Operation of the embodiment shown in FIG. 10 is carried out in the same way as described previously for the embodiments of the invention shown in FIGS. 3 to 9. Thus, referring to FIG. 11, movement of the valve needle 12 away from the seating 72 into a first fuel injecting position permits fuel in the delivery chamber 13 to flow past the seating 72, into the chamber 14, through the drillings 18 and into the passage 17. The annular recess 50 moves into communication with the first set of outlet openings 15 such that fuel in the passage 17 is able to flow, via drillings 64, into the annular recess 50 and is delivered from the first outlet openings 15. The annular recesses 52 are arranged such that, with the valve needle 12 in the first fuel injecting position, they do not communicate with the second set of outlet openings 21 and fuel flowing through the passage 17 into the sac region 22 is unable to be delivered through the second set of outlet openings 21 which remain covered by the second sealing surface 56. Thus, during this stage of operation, fuel injection only occurs through the first set of outlet openings 15.

Figure 12:
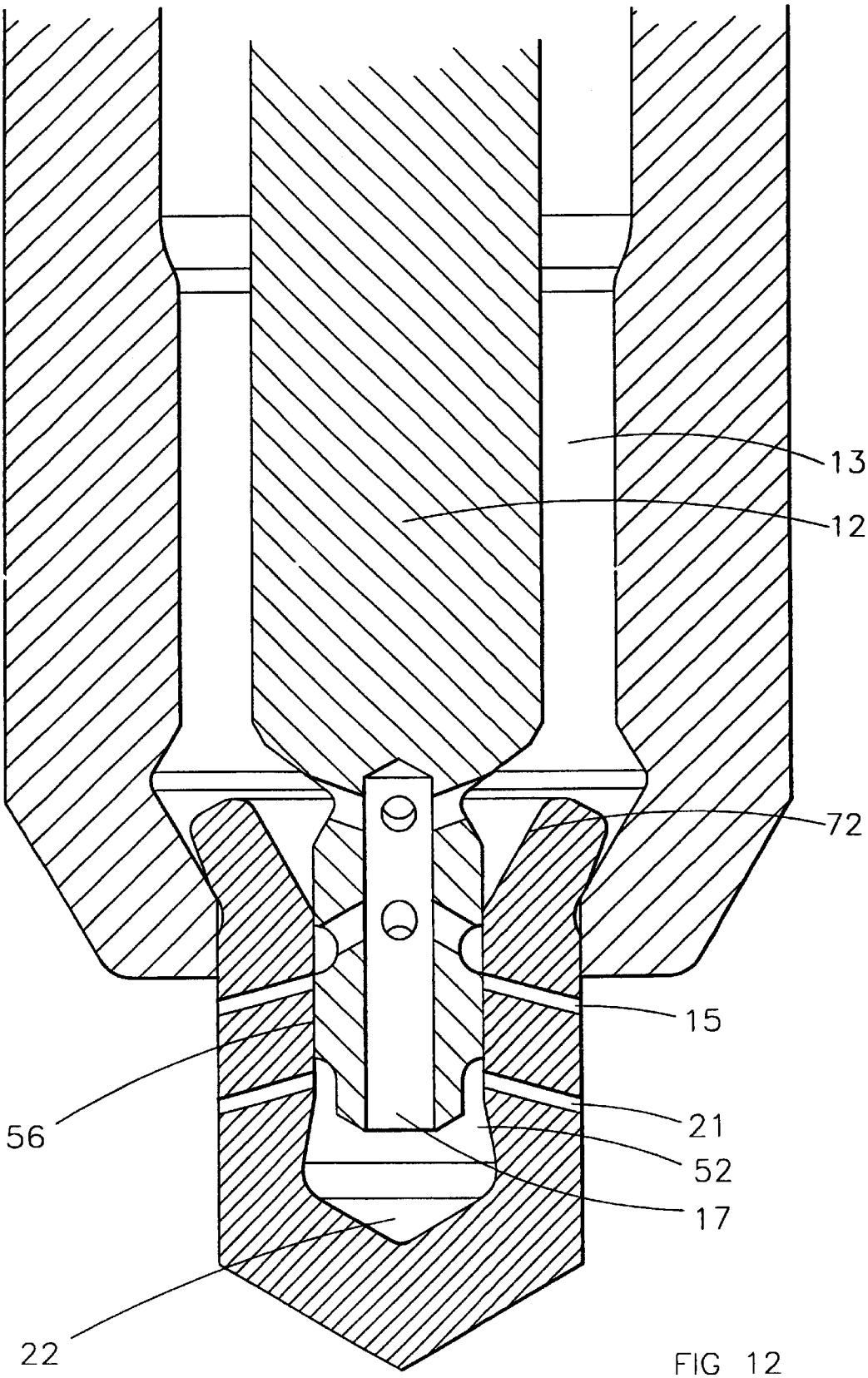
FIG. 12 is a view of the part of the fuel injector shown in FIG. 10 when in a second fuel injecting position.

Referring to FIG. 12, when the valve needle 12 is lifted away from the seating 72 by a further amount into the second fuel injecting position, the annular recess 50 moves out of communication with the first set of outlet openings 15 which becomes closed by the second sealing surfaces 56. Thus, fuel flowing from the delivery chamber 13 past the seating 72 and into the passage 17 is unable to flow from the annular recess 50 out through the first set of outlet openings 15. However, with the valve needle 12 in the second fuel injecting position, the annular recess 52 is moved into communication with the second set of outlet openings 21 such that fuel flowing through the passage 17 into the sac region 22 is able to flow, via the annular recess 52, out through the second outlet openings 21. Thus, during this stage of operation, fuel injection only occurs through the second set of outlet openings 21. As described previously, in order to cease fuel injection the valve needle 12 is returned to its seated position against the seating 72, as shown in FIG. 10.

In an alternative embodiment to that shown in FIG. 10, the seating 70 may be provided by a step of square form in the bore 65*a* of the upper part of the nozzle body 10*a*, the lower part 10*b* of the nozzle body being appropriately shaped to engage the squared seating.

Figure 11:
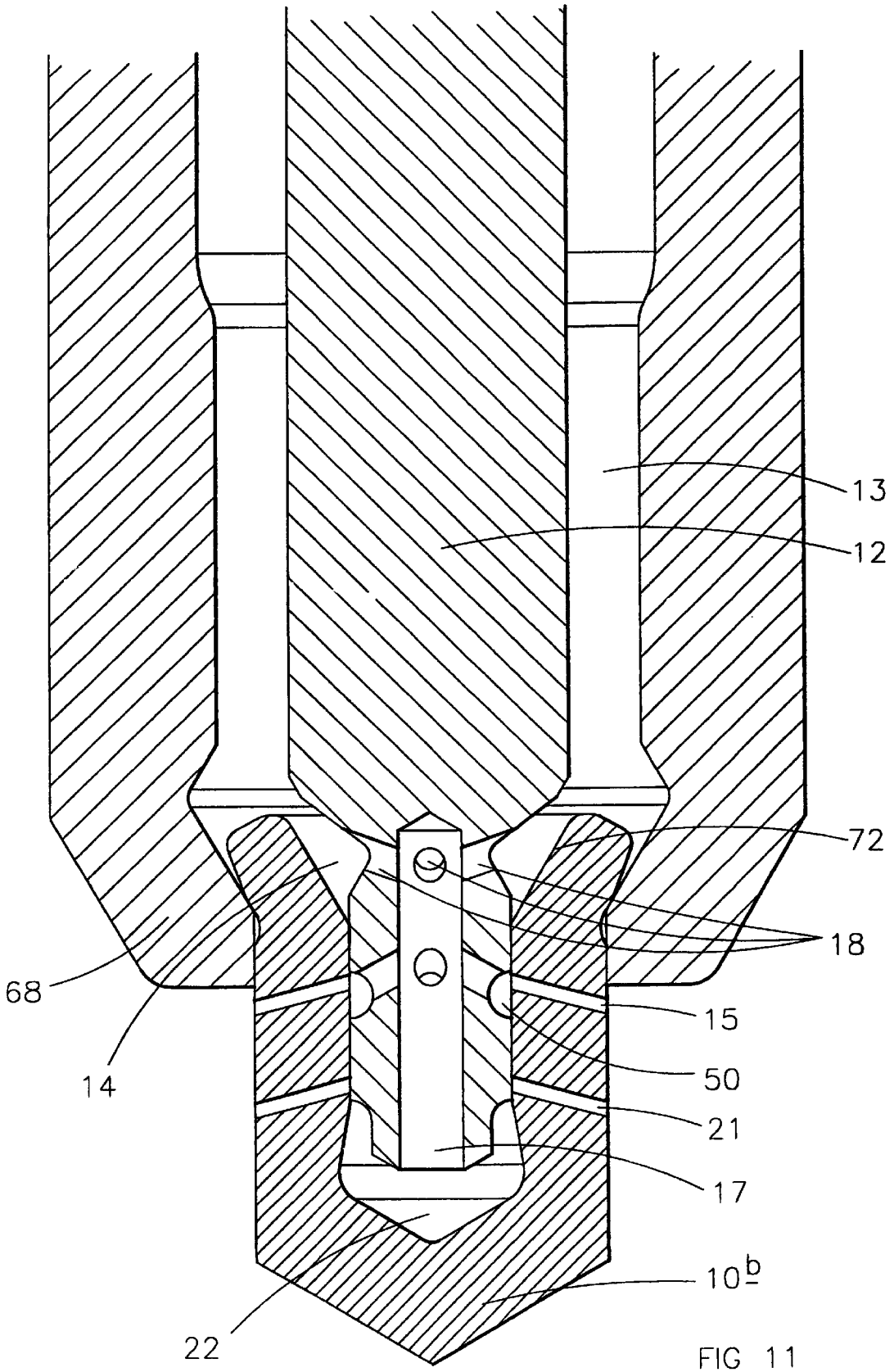
FIG. 11 is a view of the part of the fuel injector shown in FIG. 10 when in a first fuel injecting position.

As an alternative to the two-part nozzle body 10*a*, 10*b* shown in FIGS. 10–12, the nozzle body may be provided by a nozzle body part provided with a through bore, the lower open end of the through bore being closed by means of a cylindrical plug, secured in position by brazing, the seating with which the valve needle engages being defined by the through bore of the nozzle body part. This also provides a manufacturing advantage in that the lower regions of the through bore can be accessed, during manufactured, through the lower open end of the through bore.

In a further alternative embodiment of the invention the annular recesses or grooves 50, 52 may be positioned such that, with the valve needle 12 lifted away from its seating into a third fuel injecting position, fuel delivery occurs through both the first and second outlet openings 15,21 together. Thus, the fuel injector may be arranged to provide three fuel injection stages.

Figure 13:
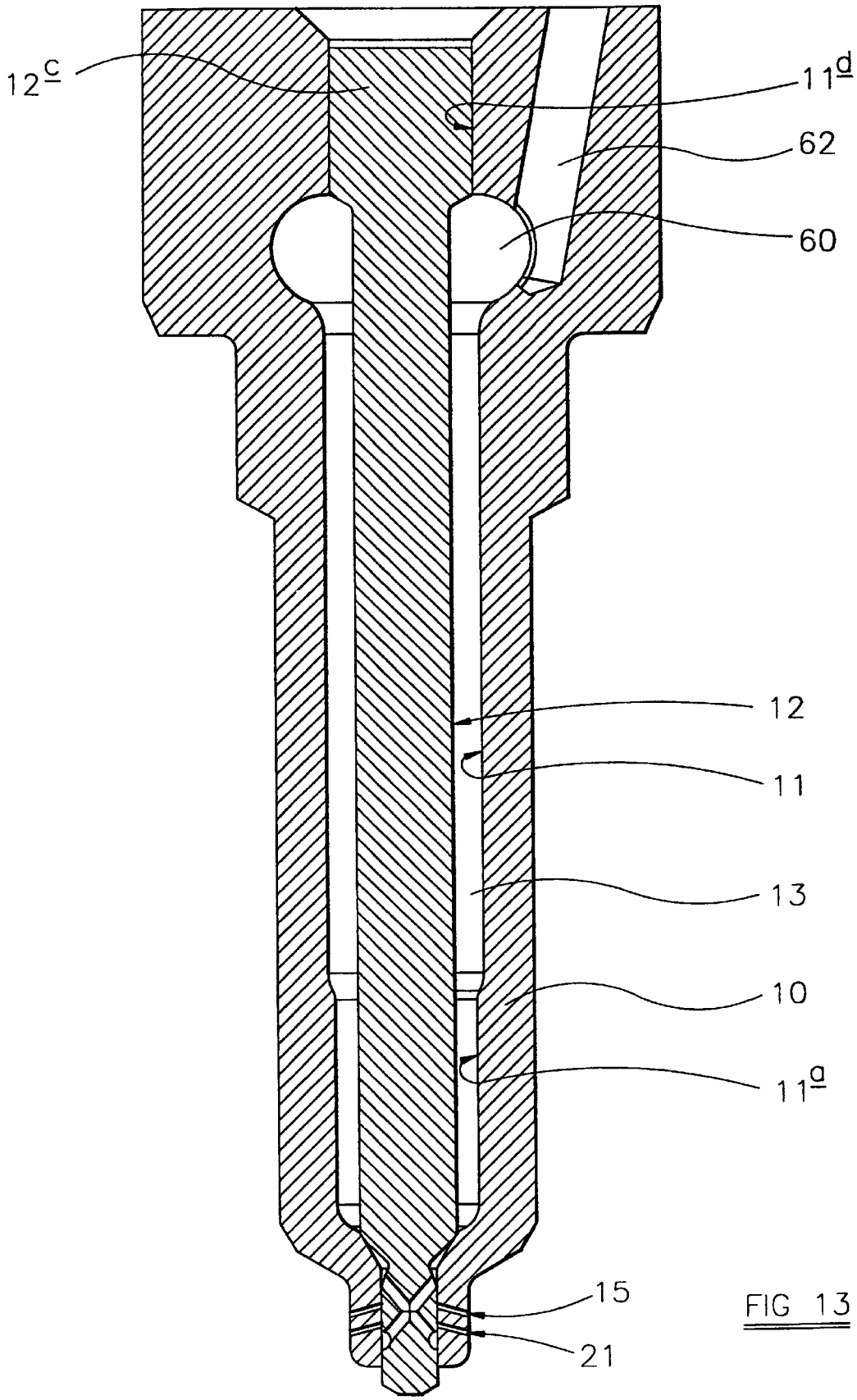
FIG. 13 is a sectional view illustrating a sixth embodiment of the fuel injector of the present invention.
Figure 14:
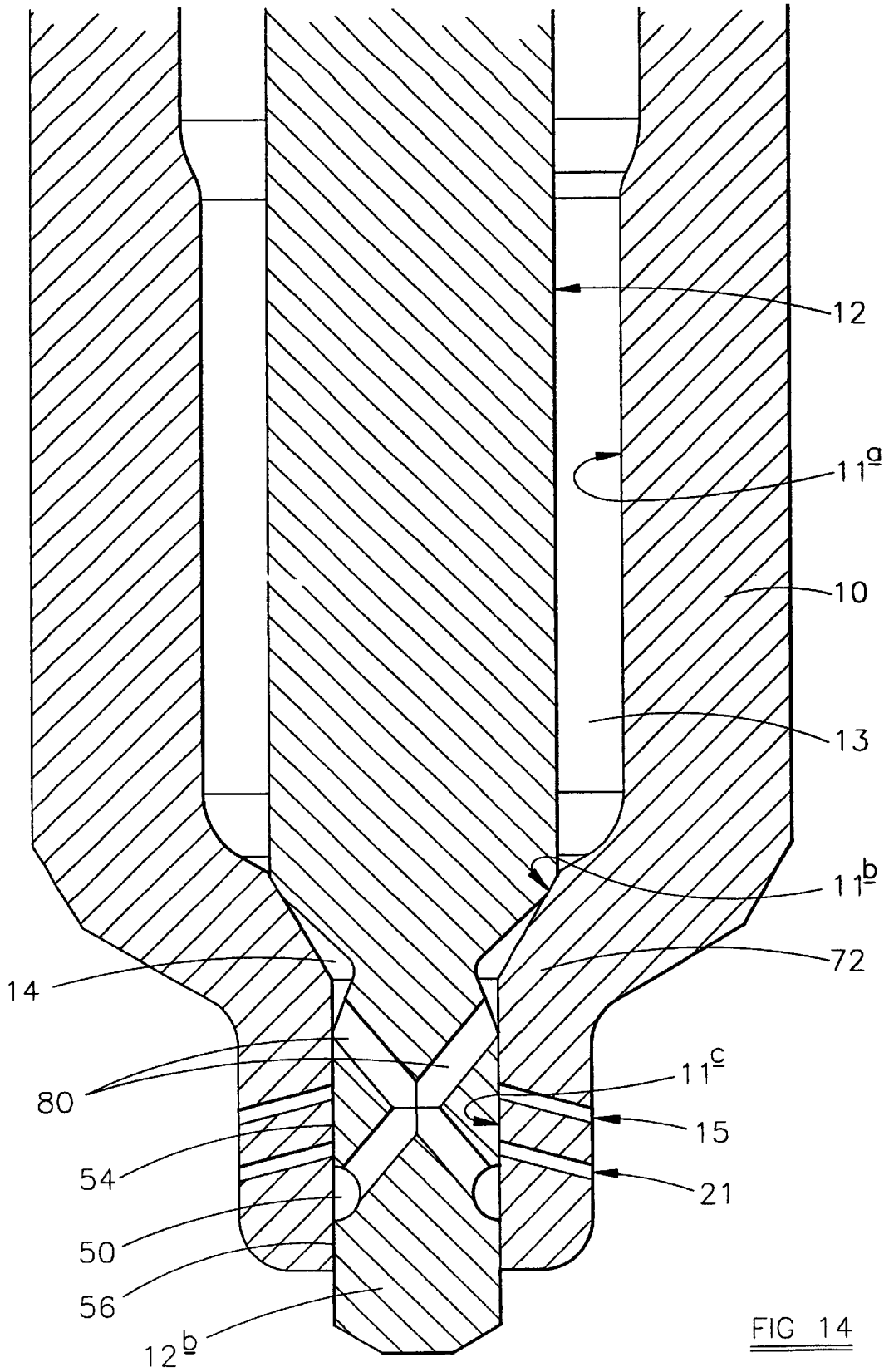
FIG. 14 is an enlarged view of a part of the fuel injector shown in FIG. 13.

FIGS. 13 and 14 show a further alternative embodiment of the invention in which similar parts to those shown in the previous figures are denoted with like reference numerals and will not be described in further detail hereinafter. In this embodiment of the invention, the region 12*b* of the valve needle 12 is provided with cross drillings 80, one end of each drilling 80 communicating with the chamber 14 and the other end of each drilling 80 communicating with an annular recess 50 formed in the valve needle region 12*b*.

With the valve needle 12 adopting the position shown in FIGS. 13 and 14, the annular recess 50 cooperates with the adjacent part of the bore region 11*c* to define an enclosed chamber with the first and second sets of outlet openings 15, 21 being closed by the sealing surface 54. Thus, with the valve needle 12 in this position, the enclosed chamber defined by the recess 50 and the bore region 11*c*, does not communicate with either the first or second set of outlet openings 15, 21.

In use, starting from the position shown in FIGS. 13 and 14, high pressure fuel is supplied through the supply passage 62, to the annular gallery 60 and, thus, to the delivery chamber 13. With the valve needle 12 seated against the seating 11*b*, fuel in the delivery chamber 13 is unable to flow past the seating 11*b* into the chamber 14. Thus, fuel injection does not occur through either the first or second outlet openings 15,21.

When fuel injection is to be commenced, the valve needle 12 is lifted away from the seating 11*b* into a fuel injecting position, as shown in FIG. 5, such that fuel in the delivery chamber 13 is able to flow past the seating 11*b* into the chamber 14. During this stage of operation, the valve needle 12 is lifted away from the seating 11*b* by an amount which is sufficient to bring the annular recess 50 into communication with the second set of outlet openings 21, the movement of the needle 12 resulting in the second set of outlet openings 21 no longer being covered by the sealing surface 54. Thus, fuel flowing past the seating 11*b* into the chamber 14 and through the cross drillings 80 is able to flow into the annular recess 50 and out through the second set of outlet openings 21. However, with the valve needle 12 moved into this fuel injecting position, the first set of outlet openings 15 remain closed by the sealing surface 54. It will therefore be appreciated that, in the fuel injecting position shown in FIG. 15, fuel injection occurs only through the second set of outlet openings 21. With fuel injection occurring through only the second set of outlet openings 21, the position of the valve needle shall be referred to as the second fuel injecting position.

Figure 15:
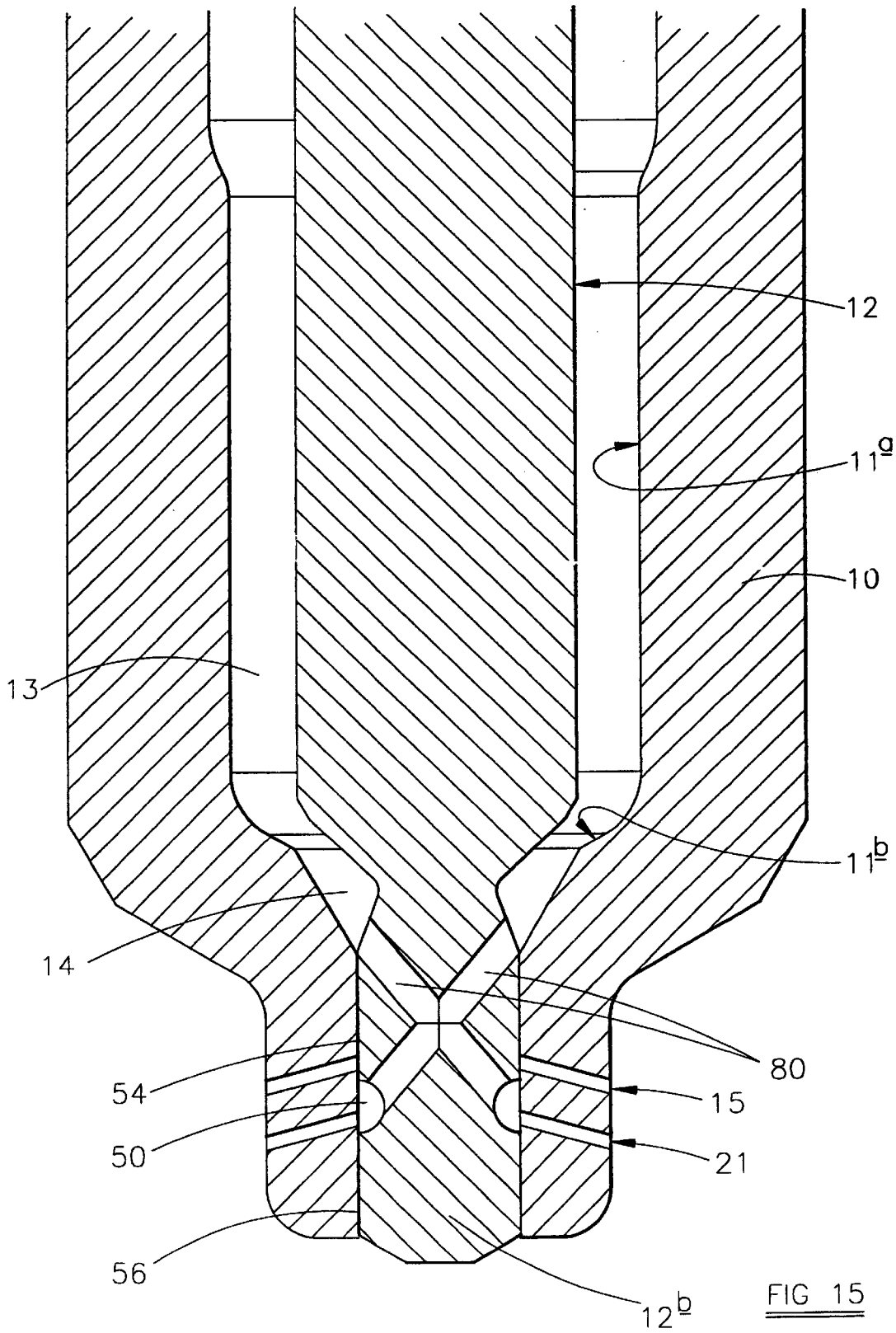
FIGS. 15 and 16 are enlarged views of the part of the fuel injector shown in FIG. 14 when in second and first fuel injecting positions respectively.

From the position shown in FIG. 15, fuel injection may be terminated by returning the valve needle 12 to its seated position against the seating 11*b*. Thus, fuel is no longer able to flow from the delivery chamber 13 into the chamber 14 and out through the second set of outlet openings 21. It will be appreciated that fuel injection will cease when the valve needle 12 is returned to its seated position and the sealing surface 54 cooperates with the bore 11*c* to break the communication between the chamber defined by the recess 50 and the second set of outlet openings 21.

Figure 16:
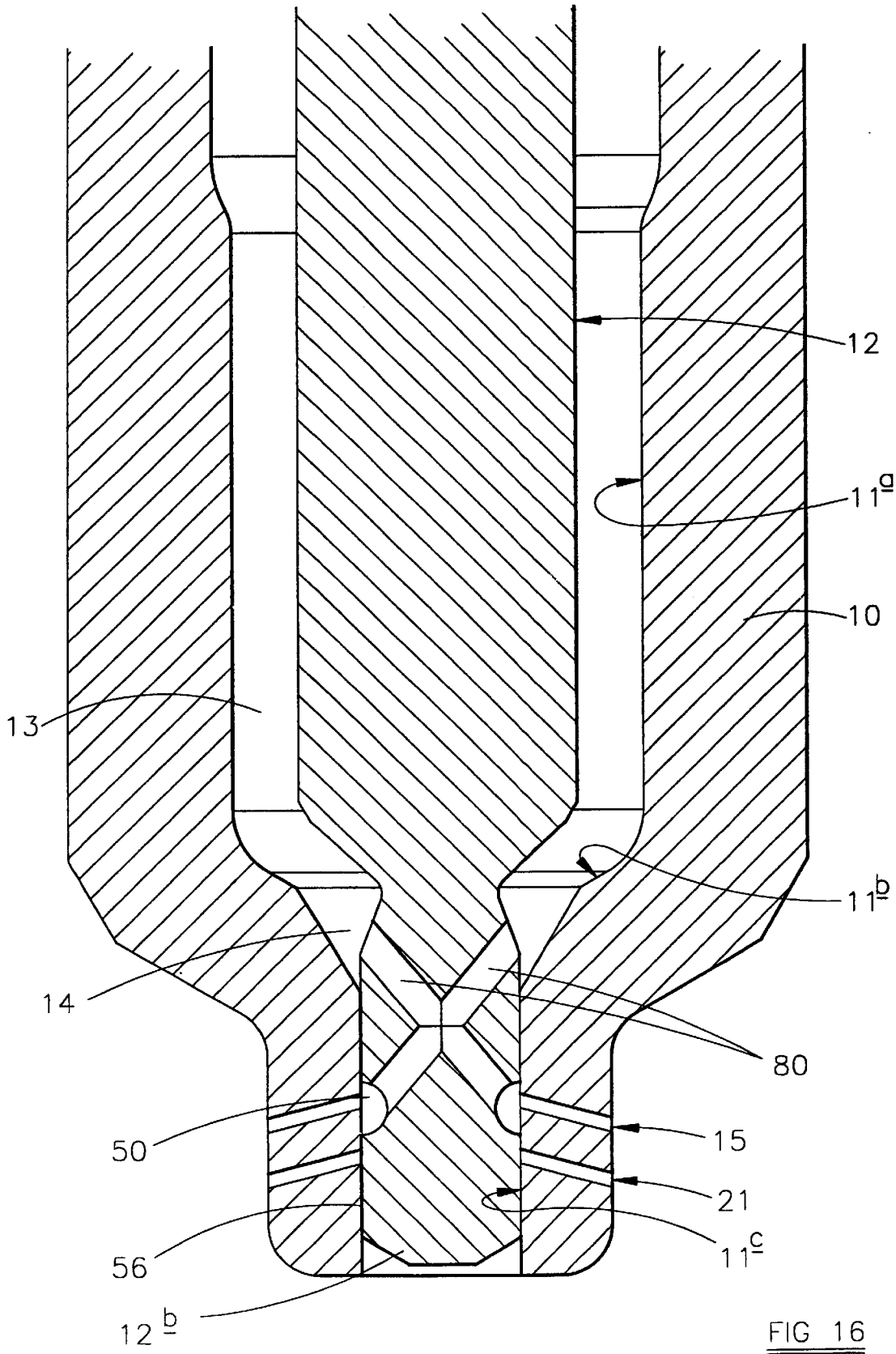

Alternatively, from the position shown in FIG. 15, if fuel injection is required through the first set of outlet openings 15, the valve needle 12 is lifted by a further amount away from the seating 11*b* into a first fuel injecting position, as shown in FIG. 16. During this stage of operation, the valve needle 12 is lifted into a position in which the annular recess 50 communicates with the first set of outlet openings 15, the second set of outlet openings 21 being closed by the second sealing surface 56. Thus, fuel in the delivery chamber 13 is able to flow past the seating 11*b* into the chamber 14, through the cross drillings 80 and into the annular recess 50 and is therefore able to flow through the first set of outlet openings 15. In the first fuel injecting position, the valve needle 12 is moved to a position in which the second sealing surface 56 seals the second set of outlet openings 21 so that fuel is not delivered therethrough. Thus, during this stage of operation, fuel injection only occurs through the first set of outlet openings 15.

The axial position of the first and second sets of outlet openings 15, 21 in the nozzle body 10, the axial position of the annular recess 50 and the size of the annular recess 50 are chosen such that, when the valve needle 12 is moved between the first and second fuel injecting positions, the annular recess 50 cooperates with the bore 11*c* to define an enclosed chamber for fuel flowing into the annular recess 50. Thus, both the first and second outlet openings 15, 21 are closed for a short period of time between the first and second stages of fuel injection. In known fuel injectors, a volume of fuel can become trapped downstream of the valve needle seating at termination of injection. This can cause leakage of fuel in an uncontrolled manner through the outlet openings into the combustion space, resulting in white smoke and noise. The fuel injector in FIGS. 13 to 16 reduces or prevents this problem, as the first and second outlet openings 15, 21 are closed for a short period of time between the first and second stages of fuel injection.

It will be appreciated, however, that in an alternative embodiment, the annular recess 50 may be of enlarged size such that, when the valve needle 12 is moved away from the seating 11*b* into the first fuel injecting position, fuel injection occurs through both the first and second sets of outlet openings 15, 21.

Figure 17:
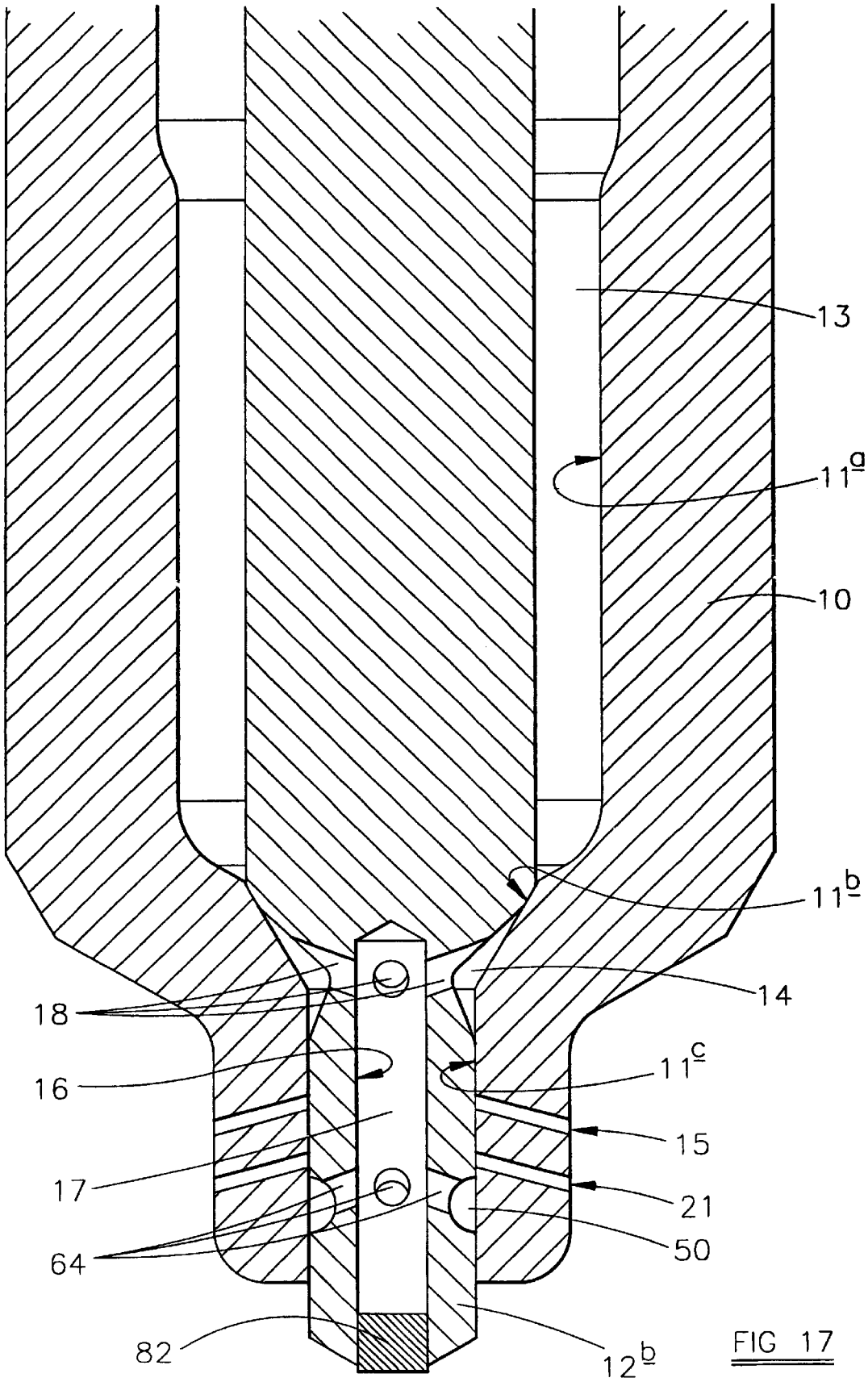
FIGS. 17, 18 and 19 are enlarged sectional views of further alternative embodiments of the fuel injector of the present invention.

FIG. 17 shows an alternative embodiment of the invention, with like reference numerals being used to denote similar parts to those shown in the previous figures. In this embodiment of the invention, the valve needle region 12*b* is also provided with additional cross drillings 64 which communicate, at one end, with the passage 17 and, at the other end, with the annular recess 50. The passage 17 is sealed, at its open end, by means of a sealing member 82, the sealing member 82 forming a substantially fluid-tight seal with the bore 16 to prevent fuel escaping through the open end of the bore 16. The sealing member 82 may be an interference fit with the bore 16, or may be brazed or screwed into position within the bore 16.

With the valve needle 12 seated against the seating 11*b*, fuel injection does not take place through either the first or second sets of outlet openings 15, 21 as fuel is unable to flow past the seating 11*b* into the passage 17. In order to commence fuel injection, the valve needle 12 is lifted away from the seating 11b, such that fuel is able to flow from the delivery chamber 13 into the chamber 14, through the drillings 18 into the passage 17 and through the drillings 64 into the annular recess 50. With the valve needle 12 lifted to a position in which the annular recess 50 communicates with either the first or second sets of outlet openings 15, 21, fuel is delivered through a selected one of the outlet openings 15, 21, depending on the extent of movement of the valve needle 12 away from the seating 11*b*.

The fuel injector shown in FIG. 17 provides the advantage that, in use, with the valve needle 12 lifted away from the seating 11*b*, high pressure fuel within the axially extending passage 17 applies an outward radial force to the valve needle region 12*b*, thereby improving the fluid-tight seal between the valve needle region 12*b* and the nozzle body 10. This reduces or prevents fuel leakage from the fuel injector between the valve needle region 12*b* and the bore 11*c*. The same advantage is also achieved with the embodiments shown in FIGS. 3 to 12.

Figure 18:
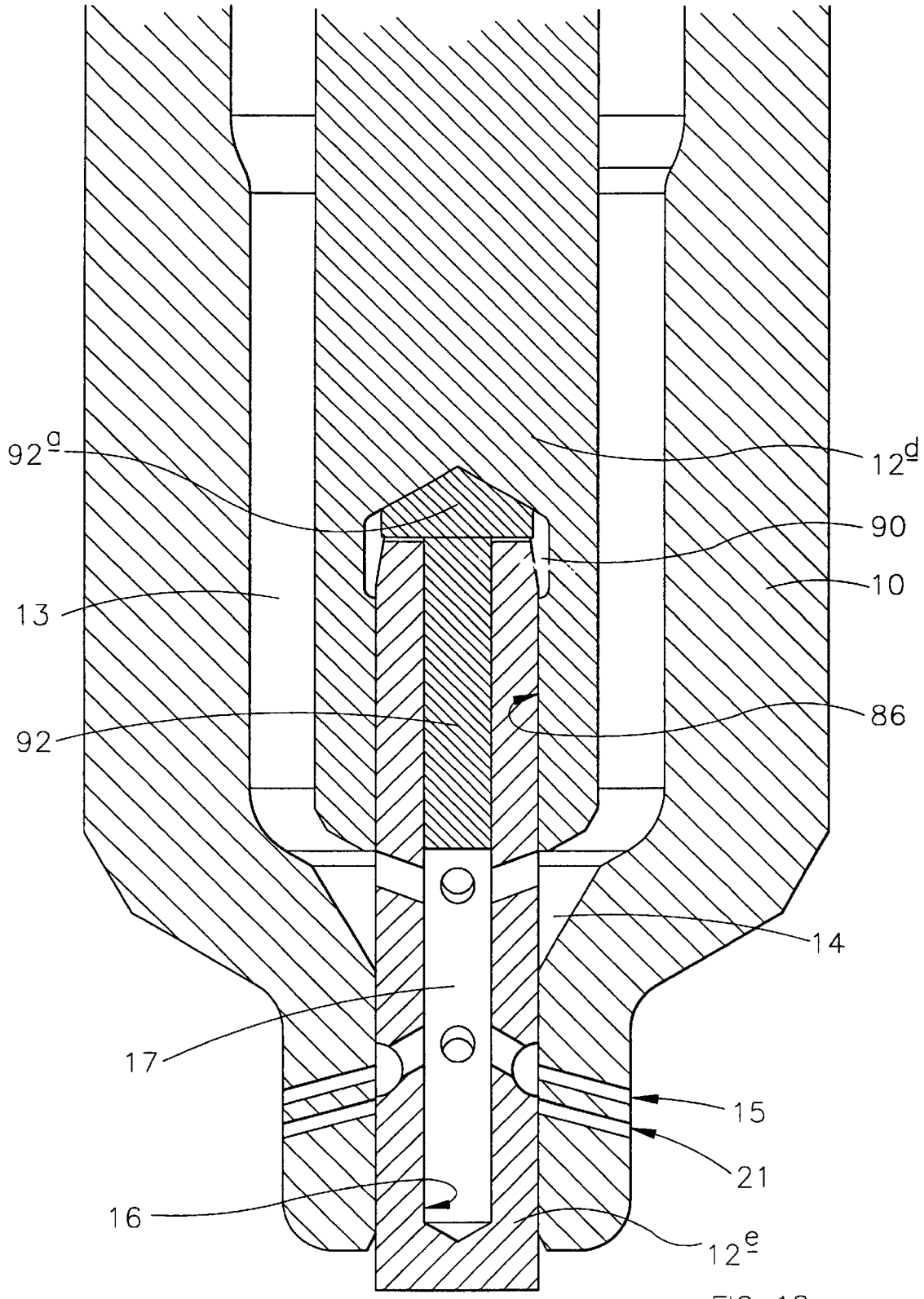

FIG. 18 is a further alternative embodiment of the invention in which the valve needle 12 is formed in two parts, an upper part 12*d* provided with a blind bore 86, and a lower part 12*e* which is received within the bore 86. The lower part 12*e* of the valve needle 12 forms an interference fit within the bore 86. The bore 86 defines, at its blind end, an annular chamber 90 within which an enlarged end region 92*a* of a plug member 92 is located, the plug member 92 being received within the bore 16 to reduce the volume available for fuel within the passage 17. The plug member 92 may form an interference fit within the bore 16 which serves to reduce the hydraulic load between the upper part 12*d* of the valve needle and the bore 86.

Operation of the embodiment of the invention shown in FIG. 18 is achieved in substantially the same way as described previously, with the valve needle being lifted away from the seating 11*b* either by a relatively small amount into a second fuel injecting position, in which fuel is delivered through the second set of outlet openings 21, or by a larger amount, into a first fuel injecting position, in which fuel is delivered through the first set of outlet openings 15. FIG. 18 shows the valve needle lifted to the first fuel injecting position, with fuel delivery occurring through the first set of outlet openings 15. This embodiment of the invention also provides the advantage that fuel pressure within the passage 17 serves to improve the fluid-tight seal between the valve needle part 12*e* and the bore 11*c* in the nozzle body 10. In addition, the fuel injector in FIG. 18 is easier to manufacture and assemble. It will be appreciated, however, that the plug member 92 need not be included, in which case the volume available for fuel within the passage 17 will be increased.

Figure 19:
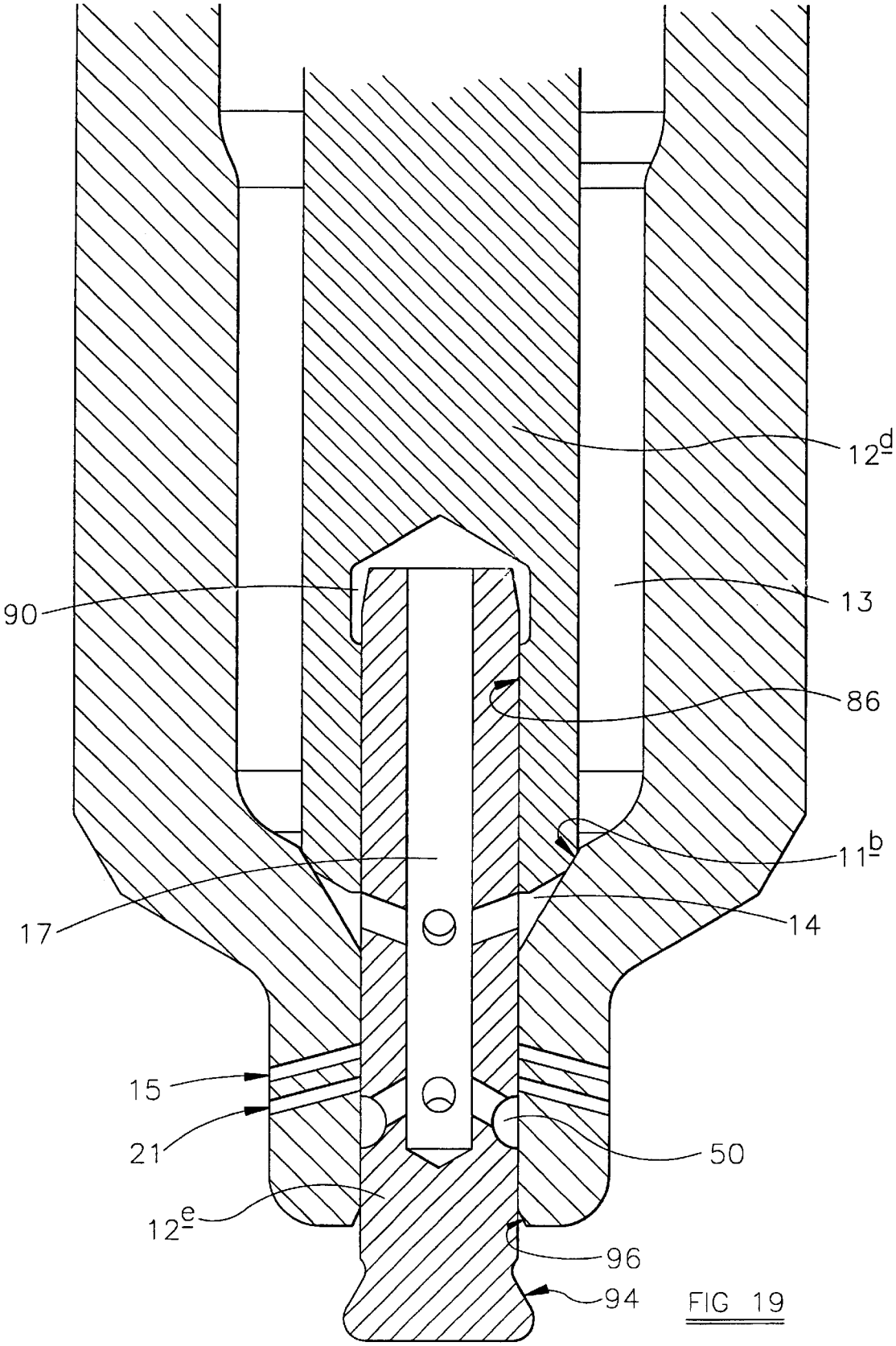

FIG. 19 is an embodiment of the invention, similar to that shown in FIG. 18, in which the end of the valve needle part 12*e* remote from the blind end of the bore 86 is of enlarged form and defines a surface 94 which is engageable with a seating 96 defined by the nozzle body 10.

Operation of the embodiment shown in FIG. 19 is carried out in the same way as described previously. Thus, referring to FIG. 20, when the valve needle 12 is lifted away from the seating 11*b* by a further amount into the first fuel injecting position, the annular recess 50 moves out of communication with the second set of outlet openings 21 which become closed by the sealing surface 56. Fuel is therefore unable to flow from the annular recess 50 out through the second set of outlet openings 21. Additionally, the annular recess 50 is moved into communication with the first set of outlet openings 15 such that fuel flowing through the passage 17 is able to flow, via the drillings 64, through the first set of outlet openings 15. Thus, during this stage of operation, fuel injection only occurs through the first set of outlet openings 15. With the valve needle 12 lifted into this first fuel injecting position, the surface 94 on the valve needle part 12*e* engages the seating 96 provided on the nozzle body 10, engagement between the surface 94 and the seating 96 forming a substantially fluid-tight seal which prevents any fuel leakage between the valve needle part 12*e* and the bore 86. As described previously, in order to cease fuel injection the valve needle 12 is returned to its seated position against the seating 11*b*, as shown in FIG. 19.

Figure 20:
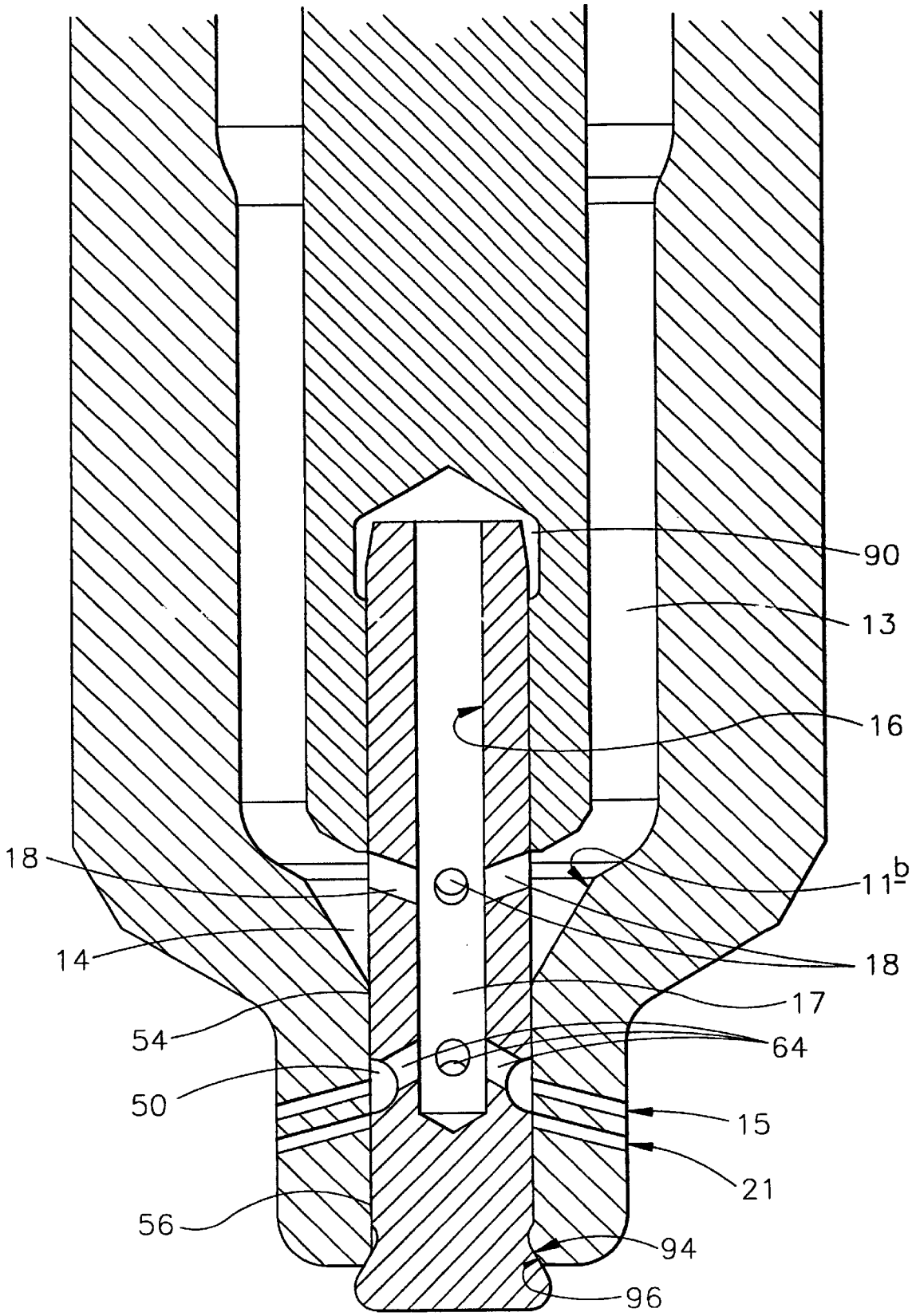
FIG. 20 is an enlarged view of the fuel injector shown in FIG. 19 when in a fuel injecting position.
Figure 21:
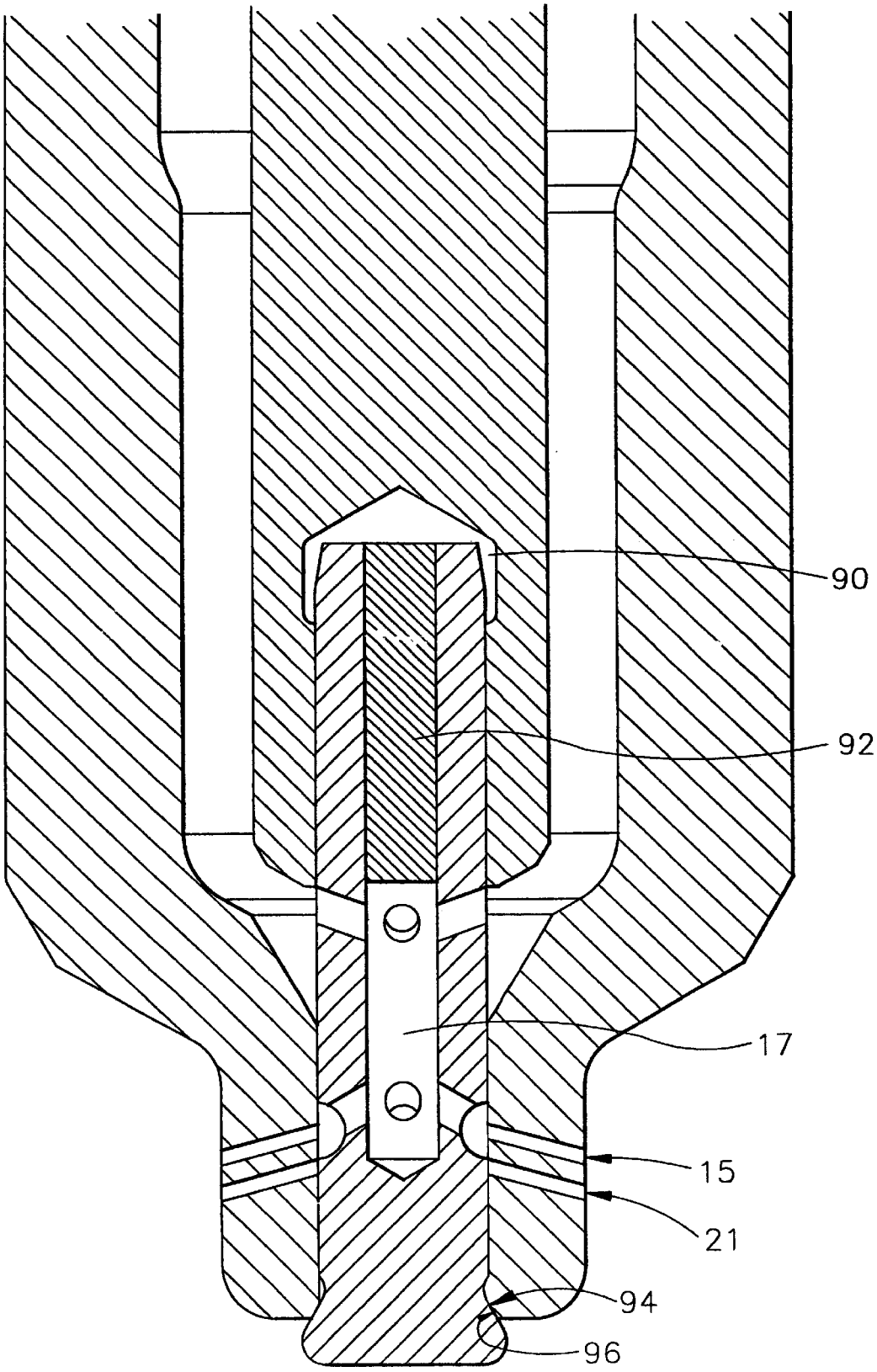
FIG. 21 is an enlarged view of a still further alternative embodiment of the fuel injector of the present invention.

Referring to FIG. 21, the embodiment shown in FIGS. 19 and 20 may also include a plug member 92, as described previously, to reduce the volume available for fuel within the passage 17.

It will be appreciated that, in any of the embodiments hereinbefore described, the annular recess or groove 50, 20 may be of arranged such that, with the valve needle 12 lifted away from its seating 11*b* into an intermediate fuel injecting position, fuel delivery occurs through both the first and second sets of outlet openings 15, 21 together. Thus, the fuel injector may be arranged to provide three fuel injection stages. Alternatively, or in addition, it will be appreciated that the nozzle body may be provided with third or further sets of outlet openings and the valve needle may be provided with additional annular recesses or grooves to permit a greater number of fuel injecting stages to be obtained. It will also be appreciated that a different number of outlet openings to those shown in the accompanying figures may be provided in the nozzle body. In addition, the outlet openings in each of the first and second sets may have a different size or may be different in number in each set such that the fuel injection characteristic can be varied by selectively injecting fuel through a different set of outlet openings. For example, the outlet openings of the first and second sets 15, 21 may be formed so as to provide a fuel spray having different cone angles.

The annular recess 50 may communicate with the passage 17 via slots, flats or grooves provided on the valve needle region 12*b*, or the valve needle part 12*e*, rather than by the drillings 18, 64, 80 and the passage 17. In this case, it is preferable to provide means for limiting angular movement of the valve needle 12 within the bore 11. For example, a device as described in British Patent Application No 9815654 may be used for this purpose.

What is claimed is:

1. A fuel injector comprising a nozzle body provided with first and second outlet openings for fuel, a valve needle slidable within a valve needle bore defined in the nozzle body, the valve needle bore being shaped to define a seating with which the valve needle is engageable to control fuel flow to a chamber, the valve needle being provided with a flow passage, movement of the valve needle away from the seating into a first fuel injecting position permitting fuel delivery from the chamber through the first outlet opening and the flow passage remaining closed to the chamber, and whereby movement of the valve needle away from the seating into a second fuel injecting position causes fuel in the chamber to flow through the flow passage for delivery through the second outlet opening.

2. The fuel injector as claimed in claim 1, wherein the valve needle has a surface shaped to define first and second sealing surfaces for the first and second outlet openings, whereby movement of the valve member away from the seating into the first fuel injecting position causes the first sealing surface to uncover the first outlet opening to permit fuel delivery therefrom and movement of the valve needle away from the seating into the second fuel injecting position causes the second sealing surface to uncover the second outlet opening to permit fuel delivery therefrom.

3. The fuel injector as claimed in claim 1, wherein the valve needle has a surface which is slidable over a guide surface to guide the valve needle for sliding movement within the valve needle bore.

4. The fuel injector as claimed in claim 3, wherein the guide surface is defined by a portion of the valve needle bore located downstream of the chamber.

5. The fuel injector as claimed in claim 3, wherein the guide surface is defined by a guide member carried by the nozzle body.

6. The fuel injector as claimed in claim 5, wherein the flow passage is provided, at least in part, within the guide member.

7. The fuel injector as claimed in claim 1, wherein the valve needle is provided with a first annular recess communicating with the first outlet opening, whereby, in use, movement of the valve needle into the first fuel injecting position causes the chamber to communicate with the first annular recess to permit fuel delivery through the first outlet opening.

8. The fuel injector as claimed in claim 7, wherein the first annular recess is arranged to permit fuel delivery through both the first and second outlet openings at the same time.

9. The fuel injector as claimed in claim 7, wherein the first annular recess is arranged such that the first and second outlet openings are closed for a period of time when the fuel injector is between the first and second fuel injecting positions.

10. The fuel injector as claimed in claim 7, wherein the valve needle is provided with a second annular recess communicating with the second outlet opening such that movement of the valve needle into the second fuel injecting position causes fuel in the chamber to flow into the second annular recess via the flow passage to permit fuel delivery through the second outlet opening.

11. The fuel injector as claimed in claim 1, wherein the valve needle is provided with an additional flow passage such that movement of the valve needle away from the seating into the first fuel injecting position causes fuel in the chamber to flow into the first annular recess via the flow passage and the additional flow passage to permit fuel delivery through the first outlet opening.

12. The fuel injector as claimed in claim 1, wherein the valve needle is provided with an axially extending bore which defines at least part of the flow passage for fuel.

13. The fuel injector as claimed in claim 12, wherein the axially extending bore in the valve needle is a blind bore, the open end of the axially extending bore being sealed by a sealing member.

14. The fuel injector as claimed in claim 1, wherein the flow passage is defined by cross drillings provided in the valve needle.

15. The fuel injector as claimed in claim 1, wherein the flow passage is defined by flats, slots, flutes or grooves provided on the valve needle.

16. The fuel injector as claimed in claim 1, wherein the valve needle comprises an upper part provided with a upper bore and a lower part provided with a lower bore, the lower part of the valve needle being received within the upper bore.

17. The fuel injector as claimed in claim 16, wherein the lower bore is a blind bore.

18. The fuel injector as claimed in claim 16, further comprising a plug member received within the lower bore to reduce the volume of the flow passage available for fuel.

19. The fuel injector as claimed in claim 1, wherein the nozzle body is shaped to define a further seating, the lower part of the valve needle including an enlarged region defining a surface which is engageable with the further seating when the valve needle is lifted to the first fuel injecting position.

20. The fuel injector as claimed in claim 1, comprising an actuator arrangement for moving the valve needle between the first and second fuel injecting positions.

21. The fuel injector as claimed in claim 1, wherein the nozzle body comprises an upper nozzle body part provided with a through bore and a lower nozzle body part provided with a blind bore, the lower nozzle body part being received in the through bore to close an open end thereof.

22. The fuel injector as claimed in claim 21, wherein the seating with which the valve needle is engageable is defined by a part of the bore provided in the lower nozzle body part.

23. The fuel injector as claimed in claim 21, wherein the first and second outlet openings are provided in the lower nozzle body part.

24. A fuel injector comprising a nozzle body provided with first and second outlet openings for fuel, a valve needle slidable within a valve needle bore defined in the nozzle body, the valve needle bore being shaped to define a seating with which the valve needle is engageable to control fuel flow to a chamber, the nozzle body including an upper nozzle body part provided with a through bore and a lower nozzle body part provided with a blind bore, the lower nozzle body part being received in the through bore to close an open end thereof.

* * * * *